US007507367B2

(12) United States Patent
Cooper

(10) Patent No.: US 7,507,367 B2
(45) Date of Patent: Mar. 24, 2009

(54) PROTECTIVE COATINGS FOR MOLTEN METAL DEVICES

(76) Inventor: Paul V. Cooper, 11247 Lake Forest Dr., Chesterland, OH (US) 44026

( * ) Notice: Subject to any disclaimer, the term of this patent is extended or adjusted under 35 U.S.C. 154(b) by 298 days.

(21) Appl. No.: 10/619,405

(22) Filed: Jul. 14, 2003

(65) Prior Publication Data

US 2004/0115079 A1 Jun. 17, 2004

Related U.S. Application Data

(60) Provisional application No. 60/395,471, filed on Jul. 12, 2002.

(51) Int. Cl.
*F04B 17/00* (2006.01)

(52) U.S. Cl. ..... 266/239; 266/286; 266/287

(58) Field of Classification Search ..... 266/280, 266/286, 287, 236, 239
See application file for complete search history.

(56) References Cited

U.S. PATENT DOCUMENTS

| | | | |
|---|---|---|---|
| 209,219 | A | 10/1878 | Bookwalter |
| 251,104 | A | 12/1881 | Finch |
| 364,804 | A | 6/1887 | Cole |
| 506,572 | A | 10/1893 | Wagener |
| 585,188 | A | 6/1897 | Davis |
| 898,499 | A | 9/1908 | O'Donnell |
| 1,100,475 | A | 6/1914 | Franckaerts |
| 1,331,997 | A | 2/1920 | Neal |
| 1,454,967 | A | 5/1923 | Gill |
| 1,518,501 | A | 12/1924 | Gill |
| 1,522,765 | A | 1/1925 | Wilke |
| 1,526,851 | A | 2/1925 | Hall |
| 1,669,668 | A | 5/1928 | Marshall |
| 1,673,594 | A | 6/1928 | Schmidt |
| 1,717,969 | A | 6/1929 | Goodner |
| 1,896,201 | A | 2/1933 | Sterner-Rainer |
| 2,038,221 | A | 4/1936 | Kagi |
| 2,280,979 | A | 4/1942 | Rocke |
| 2,290,961 | A | 7/1942 | Heuer |
| 2,488,447 | A | 11/1949 | Tangen et al. |
| 2,515,478 | A | 7/1950 | Tooley et al. |
| 2,528,210 | A | 10/1950 | Stewart |
| 2,566,892 | A | 9/1951 | Jacobs |
| 2,677,609 | A | 5/1954 | Moore et al. |

(Continued)

FOREIGN PATENT DOCUMENTS

| | | |
|---|---|---|
| CA | 683469 | 3/1964 |

(Continued)

*Primary Examiner*—Scott Kastler
(74) *Attorney, Agent, or Firm*—David E. Rogers; Squire, Sanders & Dempsey, L.L.P.

(57) ABSTRACT

Disclosed are components covered with a protective coating for use in a molten metal bath (or comparable environment) and devices including such components. The protective coating is preferably a ceramic sleeve adhered to a non-coated component by cement. A component with the protective coating is more resistant to degradation in molten metal than is the component without the coating, and may be manufactured by the process of (a) placing the protective coating over the non-coated component, and (b) injecting cement into the space between the non-coated component and protective coating, wherein at least some of the cement is injected through a passage in either the non-coated component or the protective coating.

36 Claims, 31 Drawing Sheets

U.S. PATENT DOCUMENTS

| | | | |
|---|---|---|---|
| 2,698,583 | A | 1/1955 | House et al. |
| 2,787,873 | A | 4/1957 | Hadley |
| 2,808,782 | A | 10/1957 | Thompson et al. |
| 2,821,472 | A | 1/1958 | Peterson et al. |
| 2,832,292 | A | 4/1958 | Edwards |
| 2,865,618 | A | 12/1958 | Abell |
| 2,901,677 | A | 8/1959 | Chessman et al. |
| 2,948,524 | A | 8/1960 | Sweeney et al. |
| 2,978,885 | A | 4/1961 | Davison |
| 2,984,524 | A | 5/1961 | Franzen |
| 2,987,885 | A | 6/1961 | Hodge |
| 3,010,402 | A | 11/1961 | King |
| 3,048,384 | A | 8/1962 | Sweeney et al. |
| 3,070,393 | A | 12/1962 | Silverberg et al. |
| 3,092,030 | A | 6/1963 | Wunder |
| 3,227,547 | A | 1/1966 | Szekely |
| 3,244,109 | A | 4/1966 | Barske |
| 3,251,676 | A | 5/1966 | Johnson |
| 3,255,702 | A | 6/1966 | Gehrm |
| 3,272,619 | A | 9/1966 | Sweeney et al. |
| 3,289,473 | A | 12/1966 | Louda |
| 3,291,473 | A | 12/1966 | Sweeney et al. |
| 3,400,923 | A | 9/1968 | Howie et al. |
| 3,417,929 | A | 12/1968 | Secrest et al. |
| 3,459,133 | A | 8/1969 | Scheffler |
| 3,459,346 | A | 8/1969 | Tinnes |
| 3,487,805 | A | 1/1970 | Satterthwaite |
| 3,512,762 | A | 5/1970 | Umbricht |
| 3,512,788 | A | 5/1970 | Kilbane |
| 3,575,525 | A | 4/1971 | Fox et al. |
| 3,618,917 | A | 11/1971 | Fredrikson |
| 3,650,730 | A | 3/1972 | Derham et al. |
| 3,689,048 | A | 9/1972 | Foulard et al. |
| 3,715,112 | A | 2/1973 | Carbonnel |
| 3,743,263 | A | 7/1973 | Szekely |
| 3,743,500 | A | 7/1973 | Foulard et al. |
| 3,753,690 | A | 8/1973 | Emley et al. |
| 3,759,635 | A | 9/1973 | Carter et al. |
| 3,767,382 | A | 10/1973 | Bruno et al. |
| 3,776,660 | A | 12/1973 | Anderson et al. |
| 3,785,632 | A | 1/1974 | Kraemer et al. |
| 3,814,400 | A | 6/1974 | Seki |
| 3,824,042 | A | 7/1974 | Barnes et al. |
| 3,836,280 | A | 9/1974 | Koch |
| 3,839,019 | A | 10/1974 | Bruno et al. |
| 3,871,872 | A | 3/1975 | Downing et al. |
| 3,873,305 | A | 3/1975 | Claxton et al. |
| 3,886,992 | A | 6/1975 | Maas et al. |
| 3,915,694 | A | 10/1975 | Ando |
| 3,954,134 | A | 5/1976 | Maas et al. |
| 3,961,778 | A | 6/1976 | Carbonnel et al. |
| 3,966,456 | A | 6/1976 | Ellenbaum et al. |
| 3,972,709 | A | 8/1976 | Chia et al. |
| 3,984,234 | A | 10/1976 | Claxton et al. |
| 3,985,000 | A | 10/1976 | Hartz |
| 3,997,336 | A | 12/1976 | van Linden et al. |
| 4,003,560 | A | 1/1977 | Carbonnel |
| 4,018,598 | A | 4/1977 | Markus |
| 4,052,199 | A | 10/1977 | Mangalick |
| 4,055,390 | A | 10/1977 | Young |
| 4,068,965 | A | 1/1978 | Lichti |
| 4,091,970 | A | 5/1978 | Kimiyama et al. |
| 4,119,141 | A | 10/1978 | Thut et al. |
| 4,126,360 | A | 11/1978 | Miller et al. |
| 4,128,415 | A | 12/1978 | van Linden et al. |
| 4,144,562 | A | 3/1979 | Cooper |
| 4,169,584 | A | 10/1979 | Mangalick |
| 4,192,011 | A | 3/1980 | Cooper et al. |
| 4,213,091 | A | 7/1980 | Cooper |
| 4,213,176 | A | 7/1980 | Cooper |
| 4,219,882 | A | 8/1980 | Cooper et al. |
| 4,244,423 | A | 1/1981 | Thut et al. |
| 4,286,985 | A | 9/1981 | van Linden et al. |
| 4,322,245 | A | 3/1982 | Claxton |
| 4,347,041 | A | 8/1982 | Cooper |
| 4,351,514 | A | 9/1982 | Koch |
| 4,360,314 | A | 11/1982 | Pennell |
| 4,370,096 | A | 1/1983 | Church |
| 4,372,541 | A | 2/1983 | Bocourt et al. |
| 4,375,937 | A | 3/1983 | Cooper |
| 4,392,888 | A | 7/1983 | Eckert et al. |
| 4,410,299 | A | 10/1983 | Shimoyama |
| 4,456,424 | A | 6/1984 | Araoka |
| 4,456,974 | A | 6/1984 | Cooper |
| 4,470,846 | A | 9/1984 | Dube |
| 4,489,475 | A | 12/1984 | Struttmann |
| 4,504,392 | A | 3/1985 | Groteke |
| 4,537,624 | A | 8/1985 | Tenhover et al. |
| 4,537,625 | A | 8/1985 | Tenhover et al. |
| 4,556,419 | A | 12/1985 | Otsuka et al. |
| 4,557,766 | A | 12/1985 | Tenhover et al. |
| 4,586,845 | A | 5/1986 | Morris |
| 4,593,597 | A | 6/1986 | Albrecht et al. |
| 4,598,899 | A | 7/1986 | Cooper |
| 4,600,222 | A | 7/1986 | Appling |
| 4,609,442 | A | 9/1986 | Tenhover et al. |
| 4,611,790 | A | 9/1986 | Otsuka et al. |
| 4,634,105 | A | 1/1987 | Withers et al. |
| 4,640,666 | A | 2/1987 | Sodergard |
| 4,651,806 | A | 3/1987 | Allen et al. |
| 4,696,703 | A | 9/1987 | Henderson et al. |
| 4,701,226 | A | 10/1987 | Henderson et al. |
| 4,714,371 | A | 12/1987 | Cuse |
| 4,717,540 | A | 1/1988 | McRae et al. |
| 4,743,428 | A | 5/1988 | McRae et al. |
| 4,747,583 | A | 5/1988 | Gordon et al. |
| 4,770,701 | A | 9/1988 | Henderson et al. |
| 4,786,230 | A | 11/1988 | Thut |
| 4,802,656 | A | 2/1989 | Hudault et al. |
| 4,804,168 | A | 2/1989 | Otsuka et al. |
| 4,810,314 | A | 3/1989 | Henderson et al. |
| 4,834,573 | A | 5/1989 | Asano et al. |
| 4,842,227 | A | 6/1989 | Harrington et al. |
| 4,844,425 | A | 7/1989 | Piras et al. |
| 4,851,296 | A | 7/1989 | Tenhover et al. |
| 4,859,413 | A | 8/1989 | Harris et al. |
| 4,867,638 | A | 9/1989 | Handtmann et al. |
| 4,884,786 | A | 12/1989 | Gillespie |
| 4,898,367 | A | 2/1990 | Cooper |
| 4,923,770 | A | 5/1990 | Grasselli et al. |
| 4,930,986 | A | 6/1990 | Cooper |
| 4,931,091 | A | 6/1990 | Waite et al. |
| 4,940,214 | A | 7/1990 | Gillespie |
| 4,940,384 | A | 7/1990 | Amra et al. |
| 4,954,167 | A | 9/1990 | Cooper |
| 4,973,433 | A | 11/1990 | Gilbert et al. |
| 4,989,736 | A | 2/1991 | Andersson et al. |
| 5,006,232 | A | 4/1991 | Lidgitt et al. |
| 5,028,211 | A | 7/1991 | Mordue et al. |
| 5,049,841 | A | 9/1991 | Cooper et al. |
| 5,078,572 | A | 1/1992 | Amra et al. |
| 5,088,893 | A | 2/1992 | Gilbert et al. |
| 5,092,821 | A | 3/1992 | Gilbert et al. |
| 5,098,134 | A | 3/1992 | Monckton |
| 5,099,554 | A | 3/1992 | Cooper |
| 5,131,632 | A | 7/1992 | Olson |
| 5,143,357 | A | 9/1992 | Gilbert et al. |
| 5,145,322 | A | 9/1992 | Senior, Jr. et al. |
| 5,152,631 | A | 10/1992 | Bauer |
| 5,158,440 | A | 10/1992 | Cooper et al. |
| 5,162,858 | A | 11/1992 | Shoji et al. |
| 5,165,858 | A | 11/1992 | Gilbert et al. |
| 5,172,458 | A | 12/1992 | Cooper |
| 5,177,304 | A | 1/1993 | Nagel |

5,191,154 A 3/1993 Nagel
5,192,193 A 3/1993 Cooper et al.
5,202,100 A 4/1993 Nagel et al.
5,203,681 A 4/1993 Cooper
5,209,641 A 5/1993 Hoglund et al.
5,215,448 A 6/1993 Cooper
5,268,020 A 12/1993 Claxton
5,286,163 A 2/1994 Amra et al.
5,298,233 A 3/1994 Nagel
5,301,620 A 4/1994 Nagel et al.
5,308,045 A 5/1994 Cooper
5,310,412 A 5/1994 Gilbert et al.
5,318,360 A 6/1994 Langer et al.
5,322,547 A 6/1994 Nagel et al.
5,324,341 A 6/1994 Nagel et al.
5,330,328 A 7/1994 Cooper
5,354,940 A 10/1994 Nagel
5,358,549 A 10/1994 Nagel et al.
5,358,697 A 10/1994 Nagel
5,364,078 A 11/1994 Pelton
5,369,063 A 11/1994 Gee et al.
5,383,651 A 1/1995 Blasen et al.
5,388,633 A 2/1995 Mercer, II et al.
5,395,405 A 3/1995 Nagel et al.
5,399,074 A 3/1995 Nose et al.
5,407,294 A 4/1995 Giannini
5,425,410 A 6/1995 Reynolds
5,431,551 A 7/1995 Aquino et al.
5,435,982 A 7/1995 Wilkinson
5,436,210 A 7/1995 Wilkinson et al.
5,443,572 A 8/1995 Wilkinson et al.
5,454,423 A 10/1995 Tsuchida et al.
5,468,280 A 11/1995 Areaux
5,470,201 A 11/1995 Gilbert et al.
5,484,265 A 1/1996 Horvath et al.
5,489,734 A 2/1996 Nagel et al.
5,491,279 A 2/1996 Robert et al.
5,495,746 A 3/1996 Sigworth
5,505,143 A 4/1996 Nagel
5,509,791 A 4/1996 Turner
5,537,940 A 7/1996 Nagel et al.
5,543,558 A 8/1996 Nagel et al.
5,555,822 A 9/1996 Loewen et al.
5,558,501 A 9/1996 Wang et al.
5,558,505 A 9/1996 Mordue et al.
5,571,486 A 11/1996 Robert et al.
5,585,532 A 12/1996 Nagel
5,586,863 A 12/1996 Gilbert et al.
5,597,289 A 1/1997 Thut
5,613,245 A 3/1997 Robert
5,622,481 A 4/1997 Thut
5,629,464 A 5/1997 Bach et al.
5,634,770 A 6/1997 Gilbert et al.
5,640,706 A 6/1997 Nagel et al.
5,640,707 A 6/1997 Nagel et al.
5,640,709 A 6/1997 Nagel et al.
5,655,849 A 8/1997 McEwen et al.
5,662,725 A 9/1997 Cooper
5,676,520 A 10/1997 Thut
5,678,244 A 10/1997 Shaw et al.
5,678,807 A 10/1997 Cooper
5,679,132 A 10/1997 Rauenzahn et al.
5,685,701 A 11/1997 Chandler et al.
5,690,888 A 11/1997 Robert
5,695,732 A 12/1997 Sparks et al.
5,716,195 A 2/1998 Thut
5,717,149 A 2/1998 Nagel et al.
5,718,416 A 2/1998 Flisakowski et al.
5,735,668 A 4/1998 Klein
5,735,935 A 4/1998 Areaux
5,741,422 A 4/1998 Eichenmiller et al.
5,744,117 A 4/1998 Wilkinson et al.
5,745,861 A 4/1998 Bell et al.
5,755,847 A 5/1998 Quayle
5,772,324 A 6/1998 Falk
5,776,420 A 7/1998 Nagel
5,785,494 A 7/1998 Vild et al.
5,805,067 A 9/1998 Bradley et al.
5,810,311 A 9/1998 Davison et al.
5,842,832 A 12/1998 Thut
5,858,059 A 1/1999 Abramovich et al.
5,864,316 A 1/1999 Bradley et al.
5,866,095 A 2/1999 McGeever et al.
5,875,385 A 2/1999 Stephenson et al.
5,935,528 A 8/1999 Stephenson et al.
5,944,496 A 8/1999 Cooper
5,947,705 A 9/1999 Mordue et al.
5,949,369 A 9/1999 Bradley et al.
5,951,243 A 9/1999 Cooper
5,993,726 A 11/1999 Huang
5,993,728 A 11/1999 Vild
5,995,041 A 11/1999 Bradley et al.
6,019,576 A 2/2000 Thut
6,024,286 A 2/2000 Bradley et al.
6,027,685 A 2/2000 Cooper
6,036,745 A 3/2000 Gilbert et al.
6,074,455 A 6/2000 van Linden et al.
6,093,000 A 7/2000 Cooper
6,096,109 A 8/2000 Nagel et al.
6,113,154 A 9/2000 Thut
6,123,523 A 9/2000 Cooper
6,152,691 A 11/2000 Thut
6,168,753 B1 * 1/2001 Morando ..... 266/286
6,187,096 B1 2/2001 Thut
6,217,823 B1 4/2001 Vild et al.
6,231,639 B1 5/2001 Eichenmiller et al.
6,243,366 B1 6/2001 Bradley et al.
6,250,881 B1 6/2001 Mordue et al.
6,254,340 B1 7/2001 Vild et al.
6,270,717 B1 8/2001 Tremblay et al.
6,280,157 B1 8/2001 Cooper
6,293,759 B1 9/2001 Thut
6,303,074 B1 10/2001 Cooper
6,345,964 B1 2/2002 Cooper
6,354,796 B1 * 3/2002 Morando ..... 415/121.2
6,358,467 B1 3/2002 Mordue
6,371,723 B1 * 4/2002 Grant et al. ..... 415/200
6,398,525 B1 6/2002 Cooper
6,439,860 B1 8/2002 Greer
6,451,247 B1 9/2002 Mordue et al.
6,457,950 B1 10/2002 Cooper et al.
6,464,458 B2 10/2002 Vild et al.
6,495,948 B1 12/2002 Garrett, III
6,497,559 B1 12/2002 Grant
6,524,066 B2 2/2003 Thut
6,533,535 B2 3/2003 Thut
6,551,060 B2 4/2003 Mordue et al.
6,648,026 B2 11/2003 Look et al.
6,679,936 B2 1/2004 Quackenbush
6,689,310 B1 2/2004 Cooper
6,695,510 B1 2/2004 Look et al.
6,709,234 B2 3/2004 Gilbert et al.
6,716,147 B1 4/2004 Hinkle et al.
6,723,276 B1 4/2004 Cooper
6,805,834 B2 10/2004 Thut
6,843,640 B2 1/2005 Mordue et al.
6,848,497 B2 2/2005 Sale et al.
6,869,564 B2 3/2005 Gilbert et al.
6,881,030 B2 4/2005 Thut
6,887,424 B2 5/2005 Ohno et al.
6,887,425 B2 5/2005 Mordue et al.
6,896,271 B2 5/2005 Uchida et al.
2001/0000465 A1 4/2001 Thut
2001/0012758 A1 8/2001 Bradley et al.
2002/0041788 A1 4/2002 Look et al.
2002/0102159 A1 8/2002 Thut

| | | | |
|---|---|---|---|
| 2002/0146313 | A1 | 10/2002 | Thut |
| 2002/0187947 | A1 | 12/2002 | Jarai et al. |
| 2003/0059302 | A1 | 3/2003 | Mordue et al. |
| 2003/0075844 | A1 | 4/2003 | Mordue et al. |
| 2003/0151176 | A1 | 8/2003 | Ohno et al. |
| 2003/0185679 | A1 | 10/2003 | Mordue et al. |
| 2004/0007284 | A1 | 1/2004 | Look et al. |
| 2004/0022632 | A1 | 2/2004 | Thut |
| 2004/0056395 | A1 | 3/2004 | Thut |
| 2004/0076533 | A1 | 4/2004 | Cooper |
| 2004/0084172 | A1 | 5/2004 | Vincent et al. |
| 2004/0115079 | A1 | 6/2004 | Cooper |
| 2004/0123970 | A1 | 7/2004 | Neff |
| 2004/0199435 | A1 | 10/2004 | Abrams et al. |
| 2004/0215204 | A1 | 10/2004 | Davison et al. |
| 2004/0262825 | A1 | 12/2004 | Cooper |
| 2005/0013713 | A1 | 1/2005 | Cooper |
| 2005/0013714 | A1 | 1/2005 | Cooper |
| 2005/0013715 | A1 | 1/2005 | Cooper |
| 2005/0053499 | A1 | 3/2005 | Cooper |
| 2005/0077730 | A1 | 4/2005 | Thut |
| 2005/0081607 | A1 | 4/2005 | Patel et al. |
| 2005/0116398 | A1 | 6/2005 | Tremblay |

FOREIGN PATENT DOCUMENTS

| | | | |
|---|---|---|---|
| CH | 392268 | | 9/1965 |
| DE | 1800446 | | 12/1969 |
| EP | 0665378 | A1 | 2/1995 |
| GB | 942648 | | 11/1963 |
| GB | 1185314 | | 3/1970 |
| GB | 2217784 | A | 3/1989 |
| JP | 58-048796 | | 3/1983 |
| JP | 63-104773 | | 5/1998 |
| NO | 90756 | | 1/1958 |
| SU | 416401 | | 6/1974 |
| SU | 773312 | | 10/1980 |
| WO | WO 98/25031 | | 6/1998 |

* cited by examiner

PROTECTIVE COATINGS FOR MOLTEN METAL DEVICES

CROSS REFERENCE TO RELATED APPLICATION

This application claims the benefit of provisional application No. 60/395,471, entitled "Couplings and Protective Coatings for Molten Metal Devices" and filed on Jul. 12, 2002.

FIELD OF THE INVENTION

The invention relates to components that may be used in various devices, such as pumps, degassers and scrap melters, used in molten metal baths and to devices including such components. One aspect of the invention is a component having a protective coating, wherein the component including the coating is more resistant to degradation in a molten metal bath than is the component without the coating. The invention also relates to methods for manufacturing a component including the protective coating.

BACKGROUND OF THE INVENTION

As used herein, the term "molten metal" means any metal or combination of metals in liquid form, such as aluminum, copper, iron, zinc and alloys thereof. The term "gas" means any gas or combination of gases, including argon, nitrogen, chlorine, fluorine, freon, and helium, that are released into molten metal. The components of the present invention are used in a molten metal bath, such as a molten aluminum bath, or comparable environment. A component according to the invention may be part of a device, such as a molten metal pump, scrap melter or degasser, or the component may not be part of a device.

Known molten-metal pumps include a pump base (also called a housing or casing), one or more inlets (an inlet being an opening in the housing to allow molten metal to enter a pump chamber), a pump chamber, which is an open area formed within the housing, and a discharge, which is a channel or conduit of any structure or type communicating with the pump chamber (in an axial pump the chamber and discharge may be the same structure or different areas of the same structure) leading from the pump chamber to an outlet, which is an opening formed in the exterior of the housing through which molten metal exits the pump casing. A rotor, also called an impeller, is mounted in the pump chamber and is connected to a drive system. The drive system is typically a rotor shaft connected to one end of a drive shaft, the other end of the drive shaft being connected to a motor. Often, the rotor shaft is comprised of graphite, the motor shaft is comprised of steel, and the two are connected by a coupling. As the motor turns the drive shaft, the drive shaft turns the rotor and the rotor pushes molten metal out of the pump chamber, through the discharge, out of the outlet and into the molten metal bath. Most molten metal pumps are gravity fed, wherein gravity forces molten metal through the inlet and into the pump chamber as the rotor pushes molten metal out of the pump chamber.

Molten metal pump casings and rotors usually employ a bearing system comprising ceramic rings wherein there are one or more rings on the rotor that align with rings in the pump chamber (such as rings at the inlet and outlet) when the rotor is placed in the pump chamber. The purpose of the bearing system is to reduce damage to the soft, graphite components, particularly the rotor and pump base, during pump operation.

A known bearing system is described in U.S. Pat. No. 5,203,681 to Cooper, the disclosure of which is incorporated herein by reference. As discussed in U.S. Pat. Nos. 5,591,243 and 6,093,000, each to Cooper, the disclosures of which are incorporated herein by reference, bearing rings can cause various operational and shipping problems. To help alleviate this problem, U.S. Pat. No. 6,093,000 discloses a rigid coupling to enable the use of a monolithic rotor without any separate bearing member. The rigid coupling assists in maintaining the rotor centered within the pumping chamber and rotating concentrically (i.e., without wobble).

A number of submersible pumps used to pump molten metal (referred to herein as molten metal pumps) are known in the art. For example, U.S. Pat. No. 2,948,524 to Sweeney et al., U.S. Pat. No. 4,169,584 to Mangalick, U.S. Pat. No. 5,203,681 to Cooper, U.S. Pat. No. 6,093,000 to Cooper and U.S. Pat. No. 6,123,523 to Cooper all disclose molten metal pumps. The term submersible means that when the pump is in use its base is submerged in a bath of molten metal.

Three basic types of pumps for pumping molten metal, such as molten aluminum, are utilized: circulation pumps, transfer pumps and gas-release pumps. Circulation pumps are used to circulate the molten metal within a bath, thereby generally equalizing the temperature of the molten metal. Most often, circulation pumps are used in a reverbatory furnace having an external well. The well is usually an extension of the charging well where scrap metal is charged (i.e., added).

Transfer pumps are generally used to transfer molten metal from the external well of a reverbatory furnace to a different location such as a ladle or another furnace.

Gas-release pumps, such as gas-injection pumps, circulate molten metal while releasing a gas into the molten metal. In the purification of molten metals, particularly aluminum, it is frequently desired to remove dissolved gases such as hydrogen, or dissolved metals, such as magnesium, from the molten metal. As is known by those skilled in the art, the removing of dissolved gas is known as "degassing" while the removal of magnesium is known as "demagging." Gas-release pumps may be used for either of these purposes or for any other application for which it is desirable to introduce gas into molten metal. Gas-release pumps generally include a gas-transfer conduit having a first end that is connected to a gas source and a second submerged in the molten metal bath. Gas is introduced into the first end and is released from the second end into the molten metal. The gas may be released downstream of the pump chamber into either the pump discharge or a metal-transfer conduit extending from the discharge, or into a stream of molten metal exiting either the discharge or the metal-transfer conduit. Alternatively, gas may be released into the pump chamber or upstream of the pump chamber at a position where it enters the pump chamber.

Generally, a degasser (also called a rotary degasser) includes (1) a rotor shaft having a first end, a second end and a passage for transferring gas, (2) an impeller, and (3) a drive source for rotating the rotor shaft and the impeller. The first end of the rotor shaft is connected to the drive source and to a gas source and the second end is connected to the connector of the impeller. Examples of rotary degassers are disclosed in U.S. Pat. No. 4,898,367 entitled "Dispersing Gas Into Molten Metal," U.S. Pat. No. 5,678,807 entitled "Rotary Degassers," and U.S. application Ser. No. 09/569,461 to Cooper entitled "Molten Metal Degassing Device," filed May 12, 2000, the respective disclosures of which are incorporated herein by reference.

Generally a scrap melter includes an impeller affixed to an end of a drive shaft, and a drive source attached to the other end of the drive shaft for rotating the shaft and the impeller. The movement of the impeller draws molten metal and scrap metal downward into the molten metal bath in order to melt the scrap. A circulation pump is preferably used in conjunction with the scrap melter to circulate the molten metal in order to maintain a relatively constant temperature within the molten metal. Scrap melters are disclosed in U.S. Pat. No. 4,598,899, to Cooper U.S. patent application Ser. No. 09/649,190 to Cooper, filed Aug. 28, 2000, and U.S. Pat. No. 4,930,986 to Cooper, the respective disclosures of which are incorporated herein by reference.

Molten metal pumps, scrap melters and degassers each have components that contact the molten metal bath while the device is in use. For example, the components of a molten metal pump that usually contact the molten metal bath while the pump is in use include: (a) the housing and all structures included on or in the housing, (b) the rotor, (c) the rotor shaft, (d) the support posts, (e) the gas-transfer conduit (if used), and (f) the metal-transfer conduit (if used). The components of a scrap melter or degasser that usually contact the molten metal while the device is in use include: (g) the rotor, and (h) the rotor shaft. There are also other components, such as temperature probes and lances, that are used in molten metal baths but that are not part of a larger device or assembly.

The materials forming the components that contact the molten metal bath should remain relatively stable in the bath. Structural refractory materials, such as graphite or ceramics, that are resistant to disintegration by corrosive attack from the molten metal may be used. As used herein "ceramics" or "ceramic" refers to any oxidized metal (including silicon) or carbon-based material, excluding graphite, capable of being used in the environment of a molten metal bath. "Graphite" means any type of graphite, whether or not chemically treated. Graphite is particularly suitable for being formed into pump components because it is (a) soft and relatively easy to machine, (b) not as brittle as ceramics and less prone to breakage, and (c) less expensive than ceramics.

Components comprised of graphite are still subject to corrosive attacks from the molten metal. Corrosion is usually more significant at the surface of the molten metal bath where oxygen and the molten metal interact causing oxidation and corrosion (the wearing away) of the graphite components. It has been known to place a protective coating on a graphite component by rubbing or otherwise applying cement to the component, sliding a ceramic (such as silicon carbide) sleeve onto the component (with the wet cement being between the sleeve and the component), and allowing the cement to dry thus adhering the sleeve to the component. It is also known to apply a ceramic sleeve to a component and to then insert cement at the top of the sleeve between the component and the sleeve to adhere the sleeve to the component. Some problems with these methods of adding a sleeve to a component are (a) the cement is sometimes unevenly applied, one reason for this being that the non-coated component is sometimes not centered in the sleeve, and (b) the sliding operation can scrape away some of the cement. Either of these factors, or others, may cause voids or air pockets in the dried cement between the non-coated component and the ceramic sleeve. Air pockets can lead to early failure of the component including the sleeve. Additionally, the thickness of the cement may simply be uneven, which can lead to component failure.

For example, molten metal can work its way into the air pockets and corrode the graphite behind the ceramic. Further, the air pockets provide no structural support for the sleeve. If something strikes the ceramic sleeve where there is an air pocket, the sleeve may break. Also, the air in the pocket expands while the component is in the molten metal bath, which may cause the cement to separate from the component or sleeve exacerbating the aforementioned problems. Additionally, the known methods of adding a sleeve to a component are time consuming, messy and may lead to a waste of cement.

SUMMARY OF THE INVENTION

The present invention solves these and other problems by providing a protective coating (preferably a sleeve, plate or other solid member) on components exposed to molten metal (or comparable high-temperature, corrosive environments). The component including the protective coating (hereafter, "protected component") is more resistant to the corrosive effects of the molten metal environment than is the component without the protective coating (hereafter, "non-coated component"). The protective coating preferably comprises a refractory material suitable of being used in a molten metal environment. In the preferred embodiment, the non-coated component is comprised of graphite and the protective coating is comprised of a ceramic, preferably aluminum oxide or nitride-bonded silicon carbide. The protective coating may be provided on any component exposed to the molten metal and is particularly useful on components that contact the surface of the molten metal bath, such as a rotor shaft, any of the support posts of a molten metal pump, a gas-transfer conduit, and a metal-transfer conduit of a transfer pump. The protective coating can be applied to other components such as any component of a molten metal pump, scrap melter or rotory degasser, or stand-alone components such as a lance for introducing gas into molten metal. A protective coating according to the invention is preferably a sleeve adhered to a non-coated component, and the protective coating surrounds at least part of the non-coated component. (As used herein, "sleeve" means a structure that completely surrounds part of a non-coated component. For example, a sleeve for a cylindrical non-coated component would be tubular.) The protective coating is positioned on or next to a non-coated component thereby defining a space therebetween and cement is injected into the space through a passage or passages formed in the non-coated component and/or in the protective coating. Using this method, it is less likely that there will be spaces or gaps between the protective coating and the non-coated component. The cement is then allowed to cure to adhere the protective coating to the non-coated component.

A method of applying a protective coating according to the invention comprises utilizing a frame or other structure (collectively, "frame") to properly position the protective coating relative the non-coated component. By utilizing a frame it is more likely that the non-coated component and protective coating will be properly positioned in order to avoid the cement adhering the protective coating to the non-coated component from being of an uneven thickness, thereby helping to alleviate component failure.

Alternatively, a non-coated component may be coated with refractory. The refractory is then allowed to dry thereby forming a protected component having a refractory coating.

DETAILED DESCRIPTION OF A PREFERRED EMBODIMENT

Figure 1:
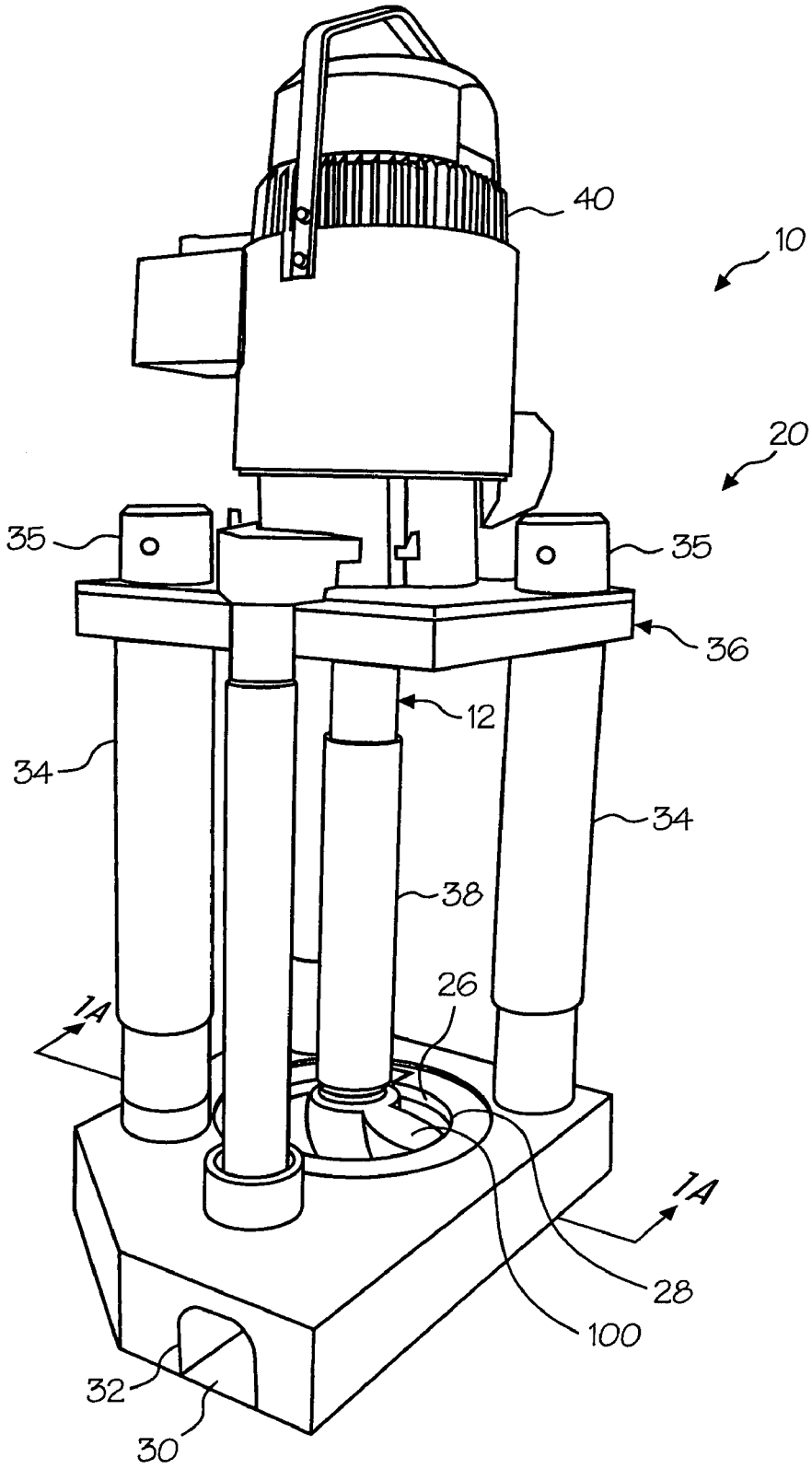
FIG. 1 is a perspective view of a pump for pumping molten metal, which includes one or more coated components according to the invention.

Referring now to the drawing where the purpose is to illustrate and describe different embodiments of the invention, and not to limit same, FIG. 1 shows a molten metal pump 10 in accordance with the present invention. System 10 includes a pump 20.

Pump 20 is specifically designed for operation in a molten metal furnace or in any environment in which molten metal is to be pumped or otherwise conveyed. Pump 20 can be any structure or device for pumping or otherwise conveying molten metal, such as the tangentical-discharge pump disclosed in U.S. Pat. No. No. 5,203,681 to Cooper, or an axial pump having an axial, rather than tangential, discharge, or any type of molten metal pump having any type of discharge. Basically, preferred pump 20 has a pump base 24 submersible in a molten metal bath B. Pump base 24 includes a generally nonvolute pump chamber 26, such as a cylindrical pump chamber or what has been called a "cut" volute (although pump base 24 may have any shape pump chamber suitable of being used, such as a volute-shaped chamber). Chamber 26 has a top inlet 28, bottom inlet 29, tangential discharge 30 (although another type of discharge, such as an axial discharge may be used), and outlet 32. One or more support posts 34 connect base 24 to a superstructure 36 of pump 20 thus supporting superstructure 36. Post clamps 35 secure posts 34 to superstructure 36. A rotor drive shaft 38 is connected at one end to rotor 100 and at the other end to a coupling (not shown in this figure). A motor 40, which can be any structure, system or device suitable for driving pump 20, but is preferably an electric, hydraulic or pneumatic motor, is positioned on superstructure 36 and is connected to a drive shaft 12. Drive shaft 12 can be any structure suitable for rotating the impeller, and preferably comprises a motor shaft (not shown in this figure) that connects to rotor shaft 38 via the coupling. Pump 20 is usually positioned in a pump well, which is part of the open well of a reverbatory furnace.

Figure 2:
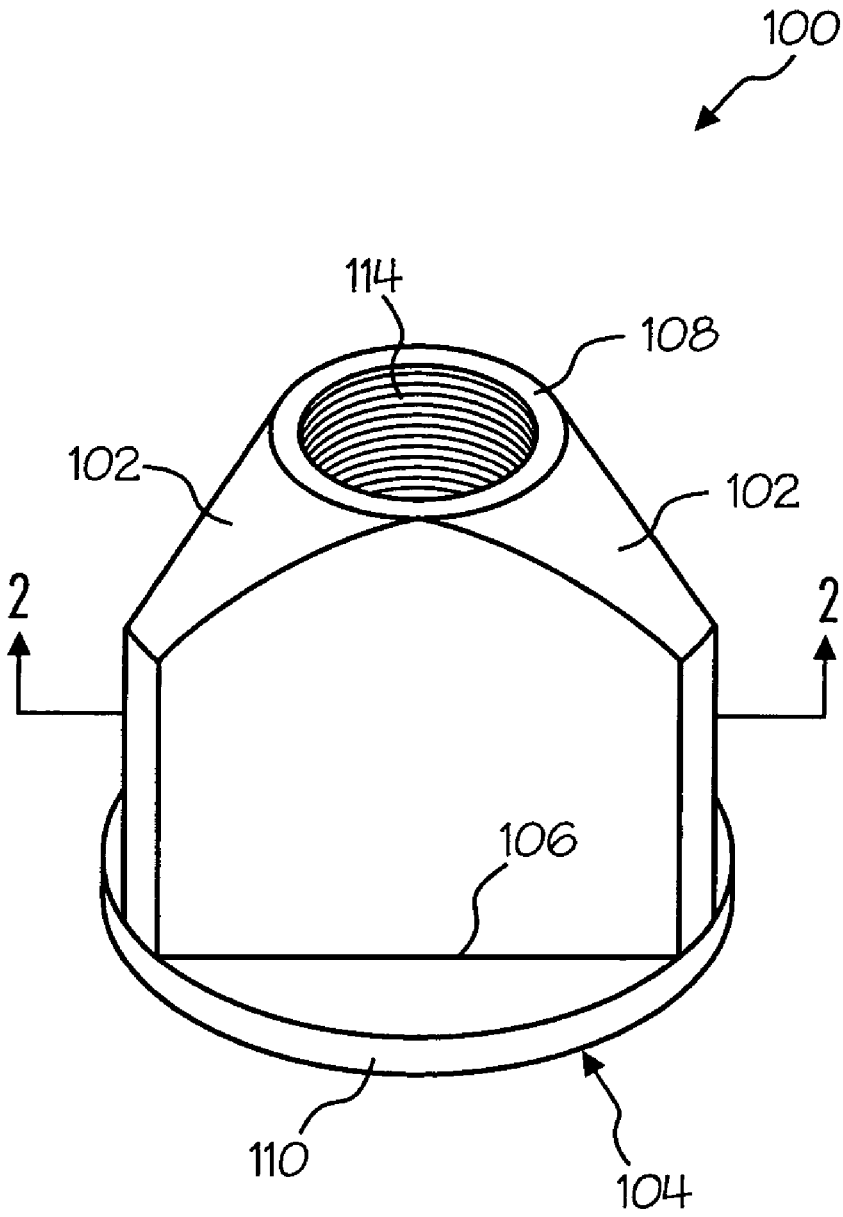
FIG. 2 is a perspective view of a rotor having a protective coating according to the FIG. 2A is a cross-sectional view of the rotor of FIG. 2, taken through lines 2-2.
Figure 2A:
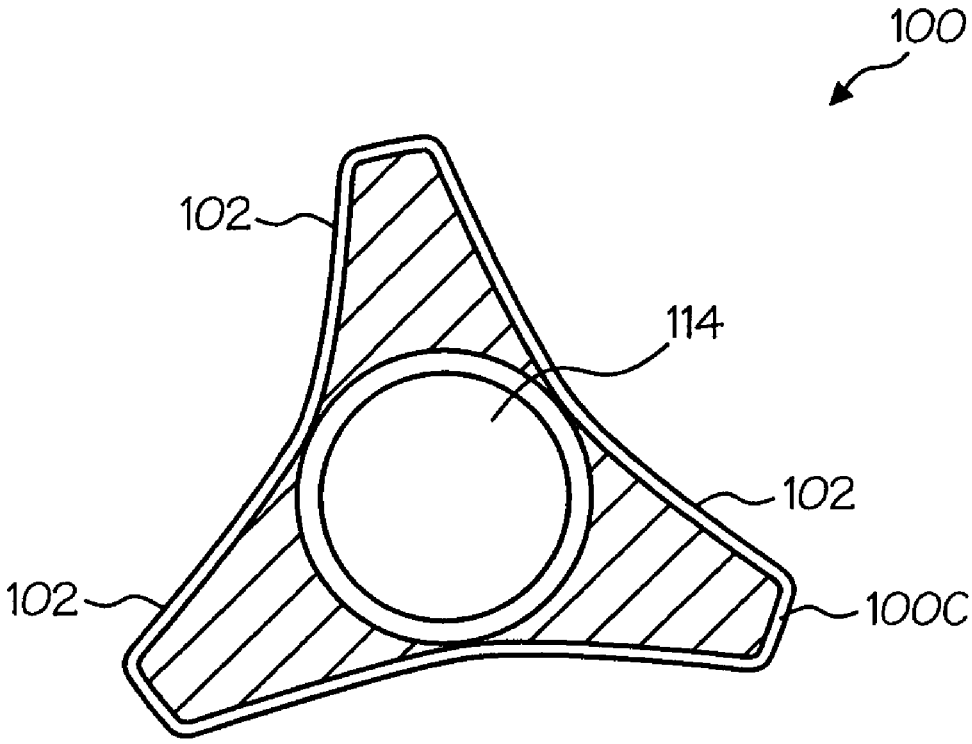

A rotor, also called an impeller, 100 is positioned at least partially within pump chamber 26. Preferred rotor 100 is preferably imperforate, triangular (or trilobal), and includes a circular base 104 (as shown in FIG. 2) although any type or shape of impeller suitable for use in a molten metal pump may be used to practice the invention, such as a vaned impeller or a bladed impeller or a bird-cage impeller, these terms being known to those skilled in the art, and the impeller may or may not include a base. For example, U.S. Pat. No. 6,093,000 to Cooper discloses numerous impellers that may be used in a pump according to the invention. Such impellers may or may not include a bearing ring, bearing pin or bearing members.

Rotor 100 shown in FIG. 2 is sized to fit through both inlet openings 28 and 29. Rotor 100 preferably has three vanes 102. Rotor 100 also has a connecting portion 114 to connect to rotor drive shaft 38. A rotor base, also called a flow-blocking and bearing plate, 104 is mounted on either the bottom 106 or top 108 of rotor 100. Base 104 is sized to rotatably fit and be guided by the appropriate one of bearing ring members 60 or 60A mounted in casing 24, shown in FIG. 3. In the embodiment shown, base 104 has an outer perimeter 110. Preferably, one of inlet openings 28 and 29 is blocked, and most preferably bottom inlet 29 is blocked, by rotor base 104.

Figure 15:
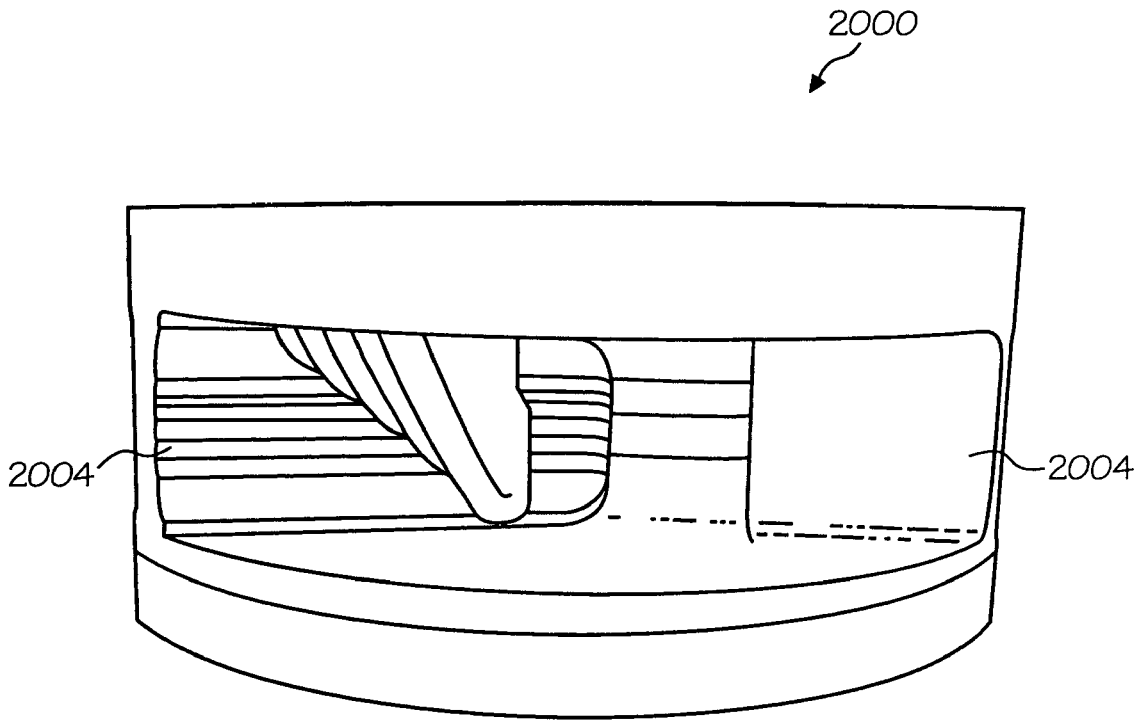
FIG. 15 is a front view of an alternate impeller that may be used to practice the invention.
Figure 16:
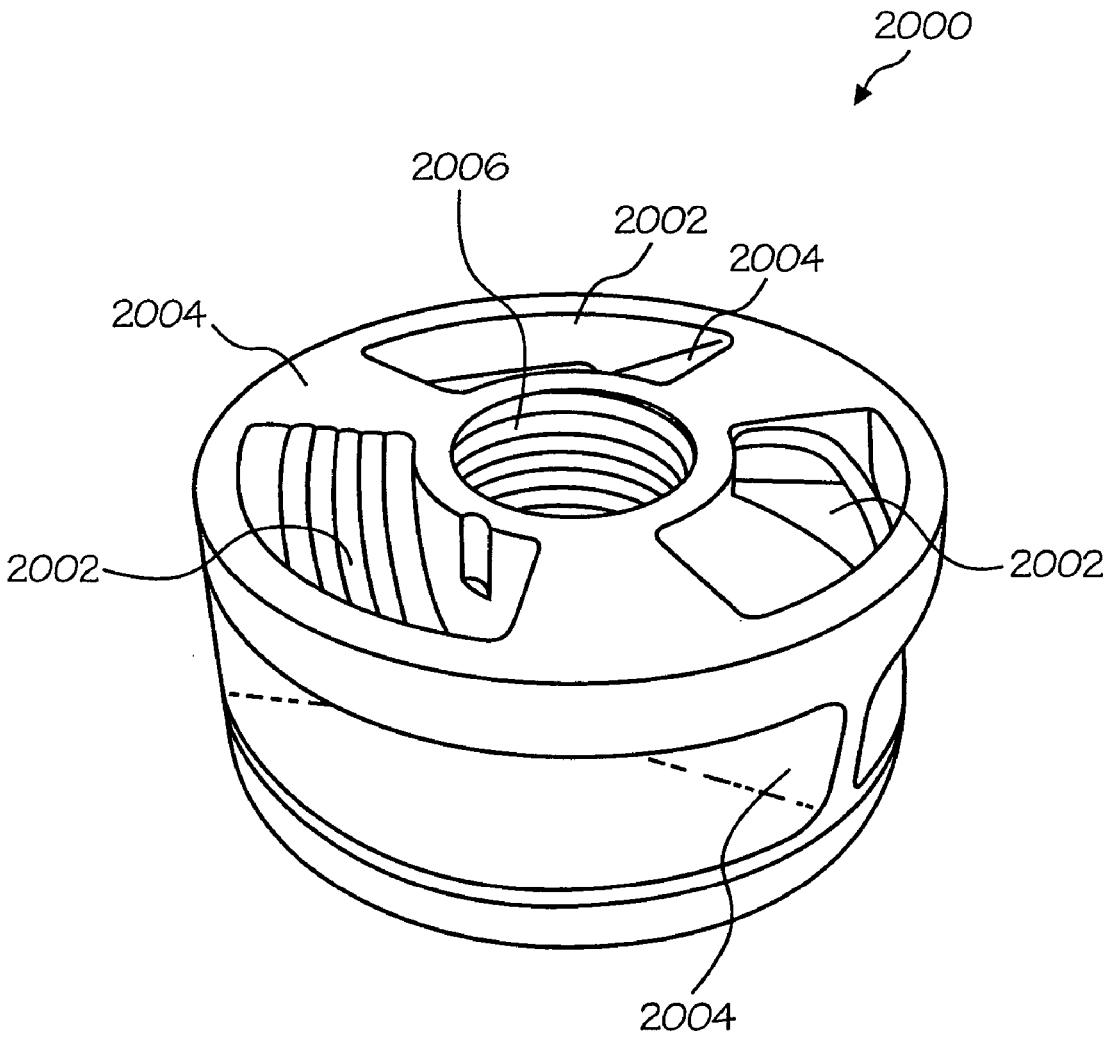
FIG. 16 is a perspective, top view of the impeller of FIG. 15.
Figure 17:
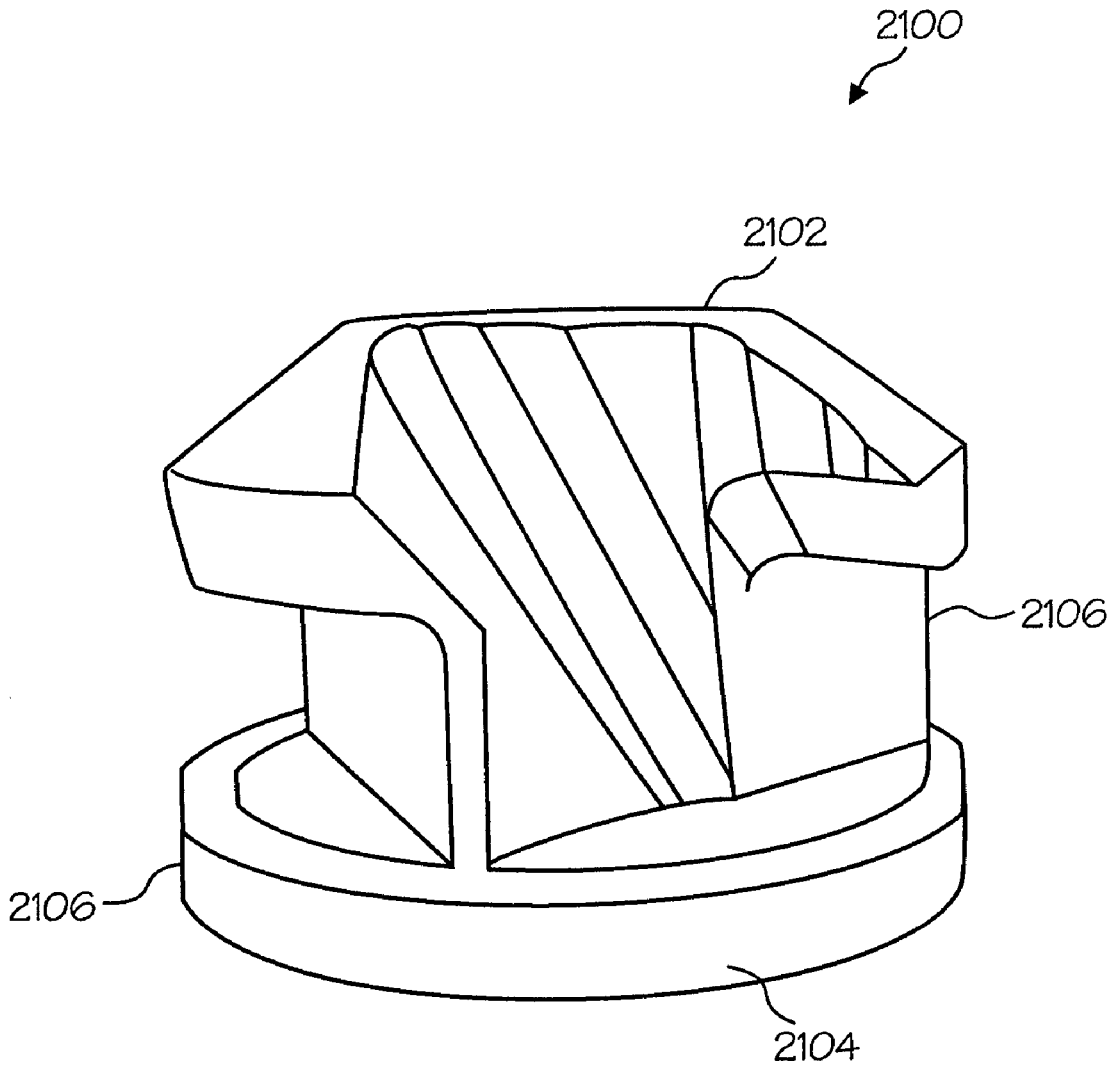
FIG. 17 is a side view of an alternate impeller that may be used to practice the invention.

Any suitable impeller may be used in the invention, and one preferred impeller is impeller 2000, shown in FIGS. 15-16. Impeller 2000 has multiple inlets 2002 preferably formed in its upper surface and multiple vanes 2004. Impeller 2000 includes a connection section 2006, which is preferably a threaded bore. Another alternate impeller 2100 is shown in FIG. 17. Impeller 2100 has a top surface 2102 including a connection section (not shown), which is preferably a threaded bore. Impeller 2100 also includes a base 2104 and vanes 2106. Either impeller 2000 or 2100 may include a coating according to the invention.

Bearing surface 110 is formed of the same material as rotor 100 and is preferably integral with rotor 100. Any of the previously described rotor configurations described herein (such as the rotors shown in U.S. Pat. No. 6,093,000) may be monolithic, having a second bearing surface comprised of the same composition as the rotor, and fitting into the pump chamber and against the first bearing surface in the manner previously described herein.

Figure 3:
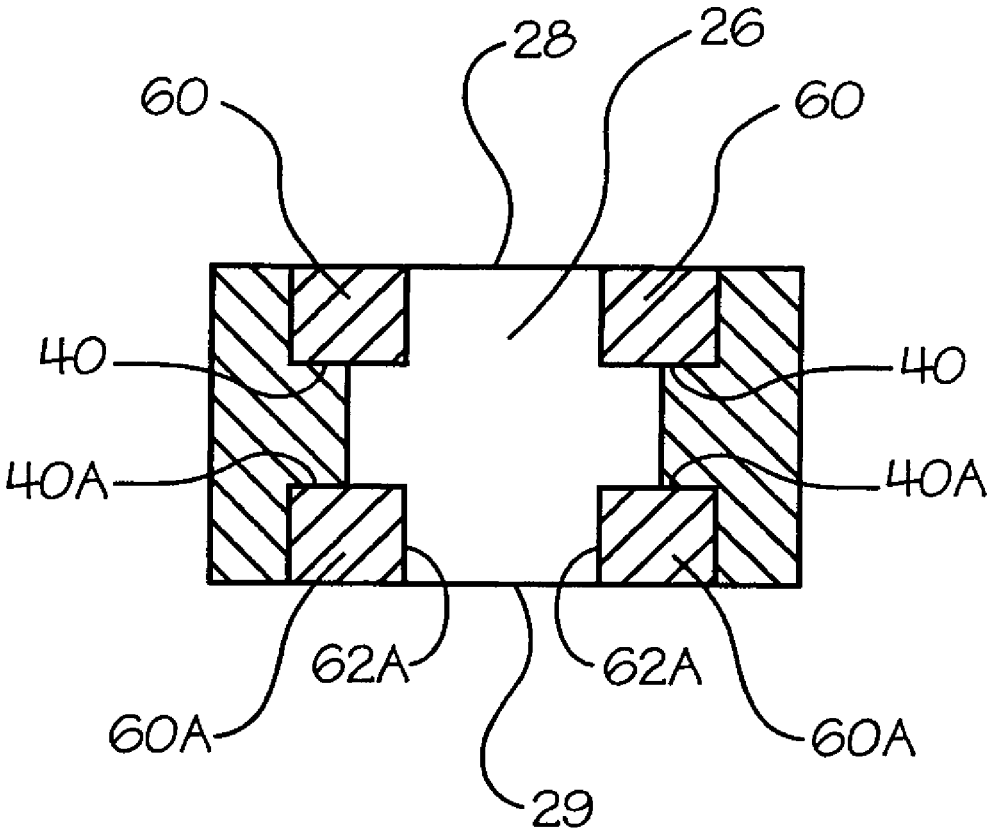
FIG. 3 is a cross-sectional view taken along line 1A-1A of FIG. 1 with the rotor removed.
Figure 3A:
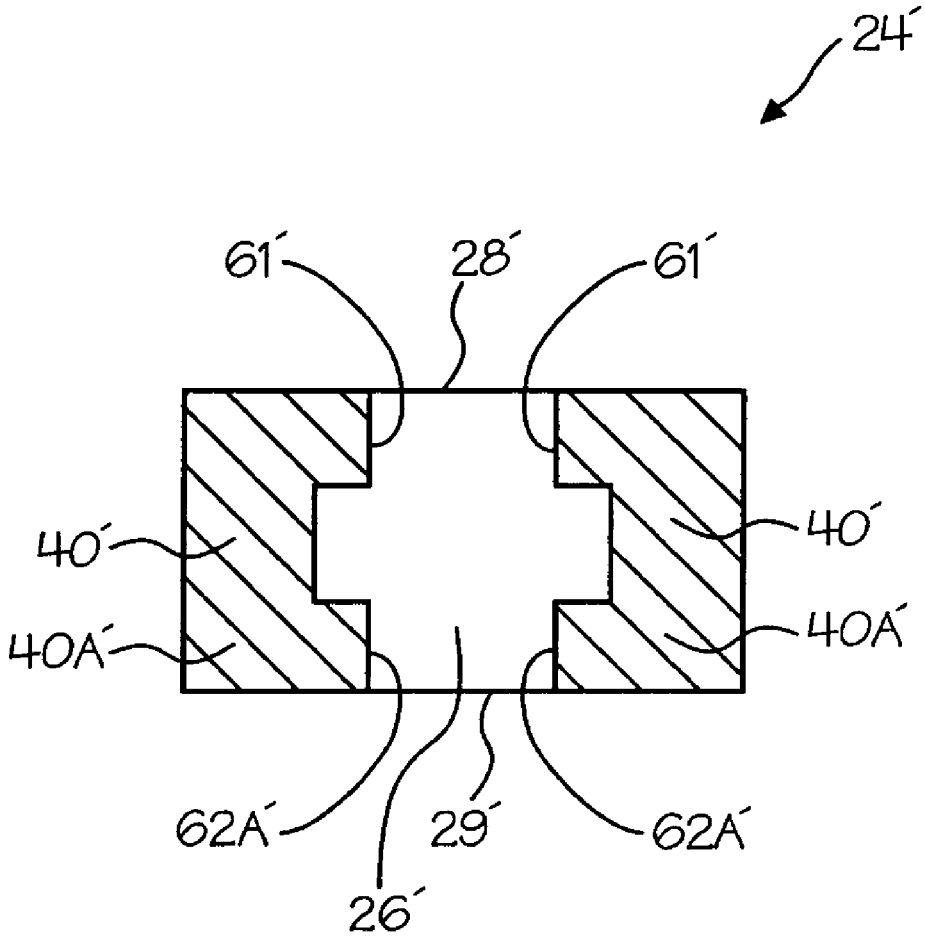
FIG. 3A is a cross-sectional view showing an alternate pump base without bearing rings.

As shown in FIG. 3, preferred pump base 24 can have a stepped surface 40 defined at the periphery of chamber 26 at inlet 28 and a stepped surface 40A defined at the periphery of inlet 29, although one stepped surface would suffice. Stepped surface 40 preferably receives a bearing ring member 60 and stepped surface 40A preferably received a bearing ring member 60A. Each bearing member 60, 60A is preferably comprised of silicon carbide. The outer diameter of members 60, 60A varies with the size of the pump, as will be understood by those skilled in the art. Bearing members 60, 60A each has a preferred thickness of 1" or greater. Preferably, bearing ring member 60, is provided at inlet 28 and bearing ring member 60A is provided at inlet 29, respectively, of casing 24. In the preferred embodiment, bottom bearing ring member 60A includes an inner perimeter, or first bearing surface, 62A, that aligns with a second bearing surface and guides rotor 100 as described herein. Alternatively, bearing ring members 60, 60A need not be used. For example, FIG. 3A shows a pump casing 24' that is preferably formed entirely of graphite, and that may have a protective coating according to the invention. Such a pump casing 24' has no bearing ring, but instead has bearing surfaces 61' and 62A' integral with and formed of the same material as pump casing 24'. Pump casing 24' preferably, in all other respects, is the same as casing 24.

The rotor of the present invention may be monolithic, meaning for the purposes of this disclosure that it has no bearing member such as a separate ring or pin. A monolithic rotor may be used with any type or configuration of pump casing, including a casing with a bearing ring or a casing without a bearing ring. Rotor 100 as shown in FIG. 2 is monolithic and preferably formed of a single composition, such as oxidation-resistant graphite, and it may include a protective coating as hereinafter described. As used herein, the term composition means any generally homogenous material and can be a homogenous blend of different materials. A monolithic rotor may be formed of multiple sections although it is preferred that it be a single, unitary component.

Most known couplings, in order to reduce the likelihood of damage to the rotor shaft, and to prevent damage to the rotor-shaft-to-motor-shaft coupling, are flexible to allow for movement. Such movement may be caused by jarring of the rotor by pieces of dross or brick present in the molten metal, or simply by forces generated by the movement of the rotor within the molten metal. Such a coupling is disclosed in pending U.S. patent application Ser. No. 08/759,780 to Cooper entitled "Molten Metal Pumping Device," the disclosure of which is incorporated herein by reference. Another flexible coupling is described in U.S. Pat. No. 5,203,681 to Cooper at column 13, l. 47-column 14, l. 16.

When a monolithic rotor is used, it is preferred that the rotor be rigidly centered in the pump casing and, hence, within the first bearing surface, such as surface 62A' shown in FIG. 3A. The preferred method for rigidly centering the rotor is by the use of a rigid motor-shaft-to-rotor-shaft coupling, such as the one described in greater detail in a co-pending U.S. Patent Application entitled "Couplings For Molten Metal Devices," filed on Jul. 14, 2003, to Paul V. Cooper, the disclosure of which is incorporated herein by reference. Another rigid coupling that may be used is described in U.S. Pat. No. 6,093,000 to Cooper. Maintaining the rotor centered helps to ensure a smooth operation of the pump and reduces the costs involved in replacement of damaged parts.

Figure 18:
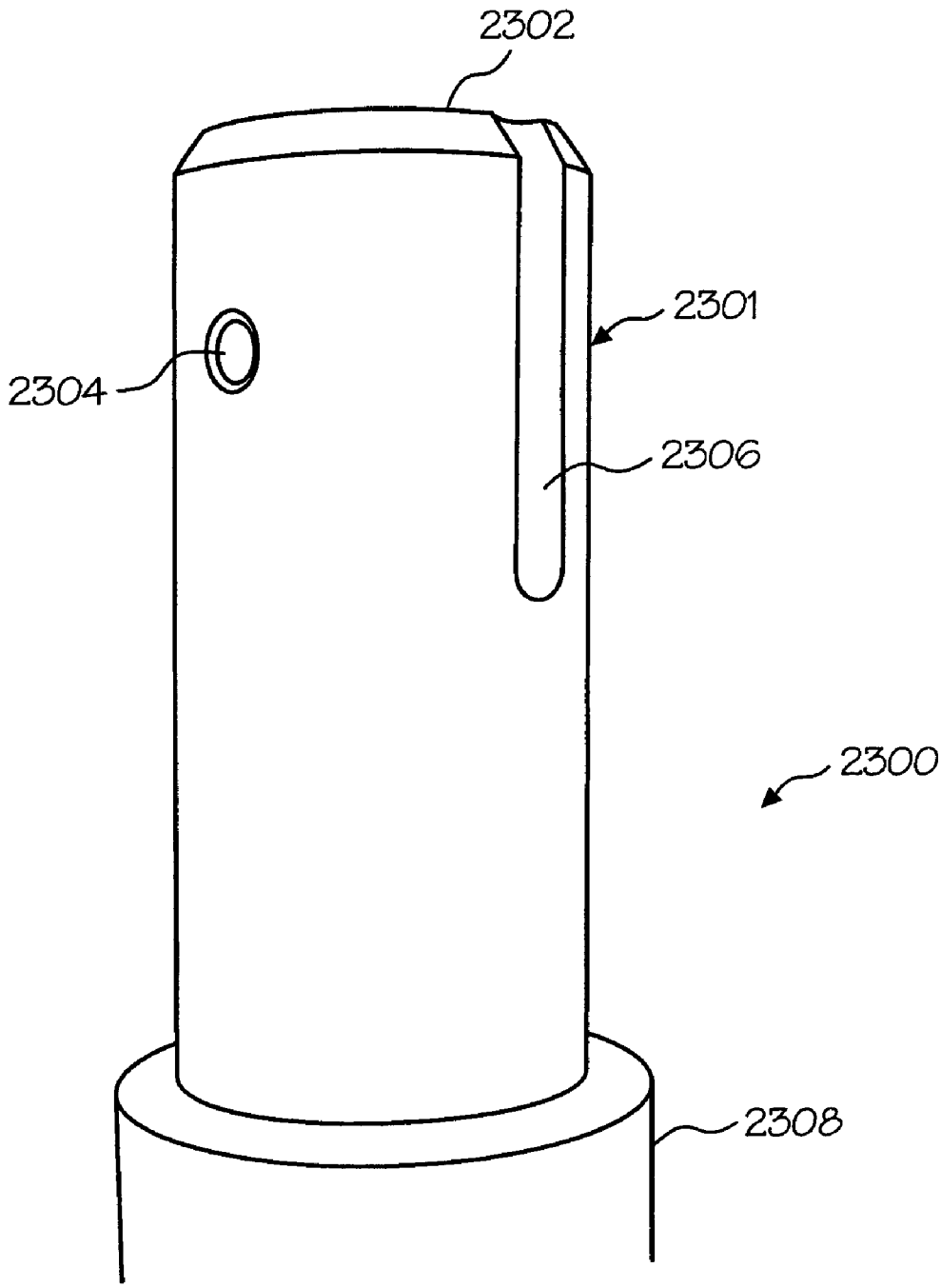
FIG. 18 is an end of an alternate rotor shaft according to the invention.
Figure 19:
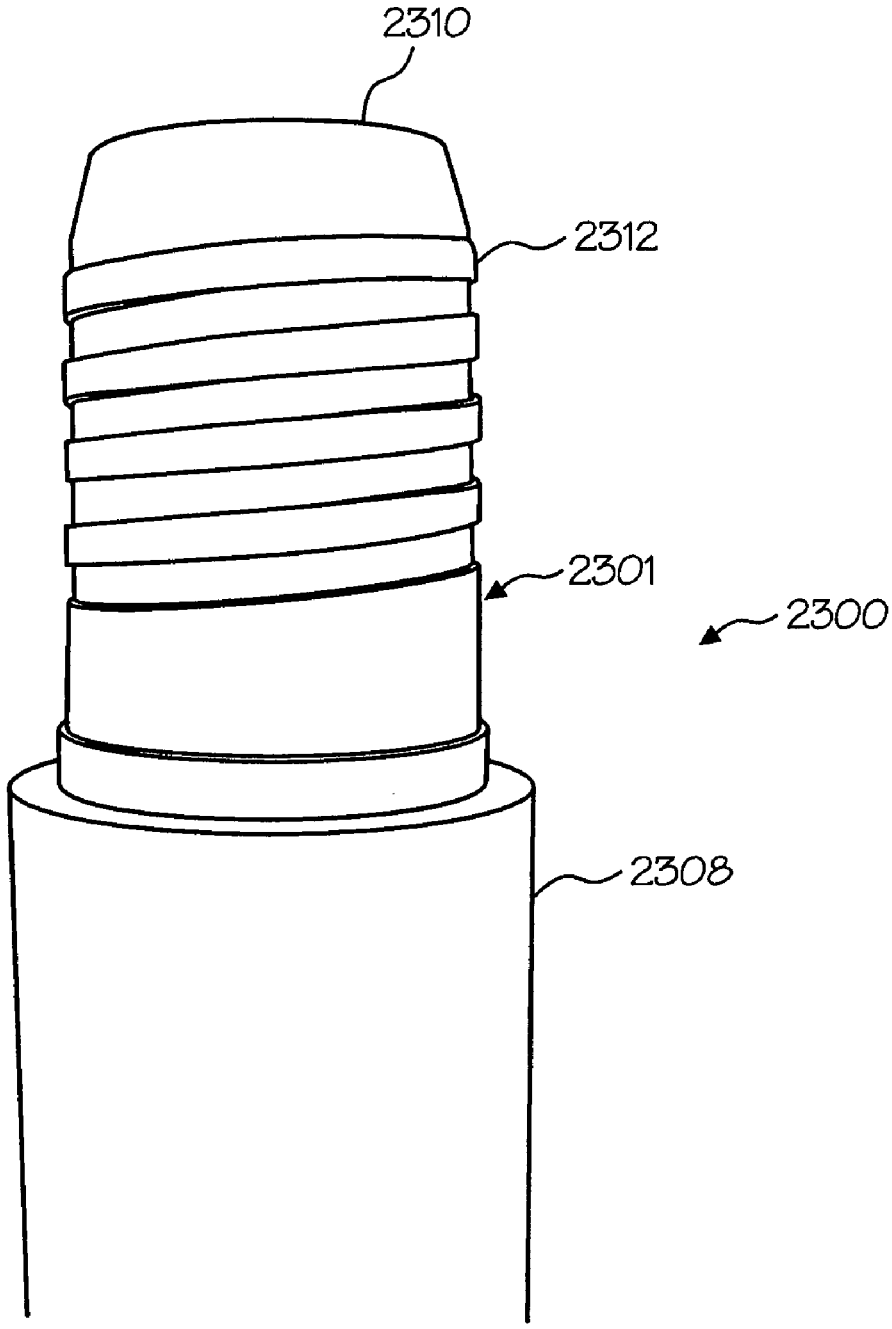
FIG. 19 is the opposite end of the rotor shaft of FIG. 18.

A rotor shaft 2300 is shown in FIGS. 18 and 19. Shaft 2300 may be used with impeller 2000 or 2100 or any suitable impeller for use in a molten metal pump. Shaft 2300 has anon-coated graphite component 2301, a first end 2302 and a second end 2310. End 2302 has a bolt hole 2304 and a groove 2306 formed in its outer surface. A protective coating 2308 is positioned on non-coated component 2301 and extends from end 2302 to end 2310. Second end 2310 has flat, shallow threads 2312, although second end 2310 can have any structure suitable for connecting to a rotor.

Figure 20:
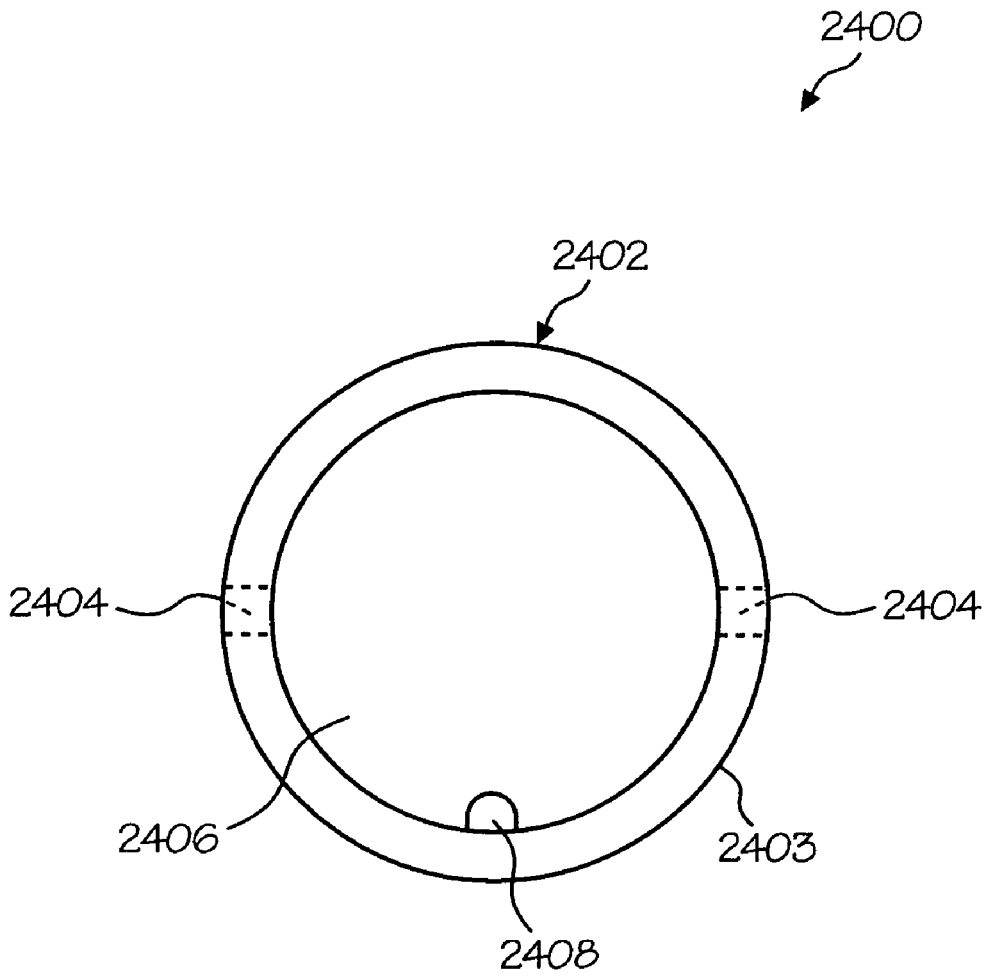
FIG. 20 is a partial cross-sectional end view of a coupling that may be used with the shaft of FIGS. 18-19.
Figure 21:
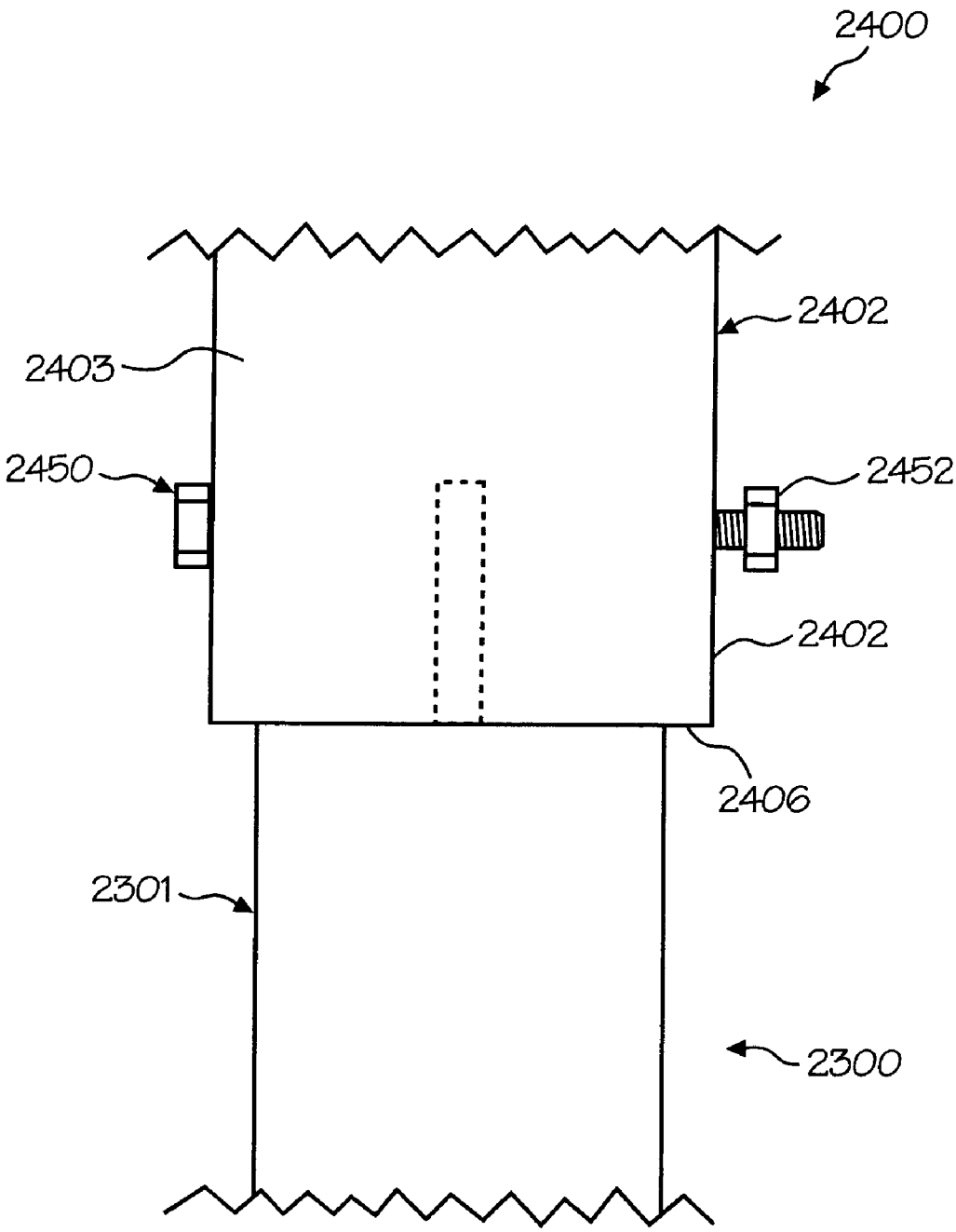
FIG. 21 is a partial side, partial cross-sectional end view of the coupling of FIG. 20 connected to the end of the rotor shaft shown in FIG. 18.

A coupling 2400 is shown in FIGS. 20 and 21. Coupling 2400 has a second end 2402 designed for coupling a rotor shaft having an end configured like end 2302 of shaft 2300 and further includes a first end configured to couple to the end of a motor shaft. The first end configured to couple to a motor shaft has the same structure as shown and described in one or more of the references to Cooper incorporated by reference herein, and shall not be described in detail here.

Second end 2402 of coupling 2400 has an annular outer wall 2403 and two aligned apertures 2403 formed therein. A cavity 2406 is defined by wall 2403 and a ridge 2408 is positioned on the inner surface of wall 2403. Ridge 2408 is preferably a section of steel welded to wall 2403 such that its end is substantially flush with the end of section 2402. Ridge 2408 preferably has a length no greater than, and most preferably less than, the length of groove 2306.

As best seen in FIG. 21, end 2302 is received in cavity 2406 and groove 2306 receives ridge 2408. Bolt hole 2304 aligns with apertures 2404 and a bolt 2450 is passed through apertures 2404 and through bolt hole 2304. A nut 2452 is then secured to end bolt 2450. In this manner, shaft 2300 is driven by the connection of groove 2306 and ridge 2408 and is less likely to be damaged.

Figure 10:
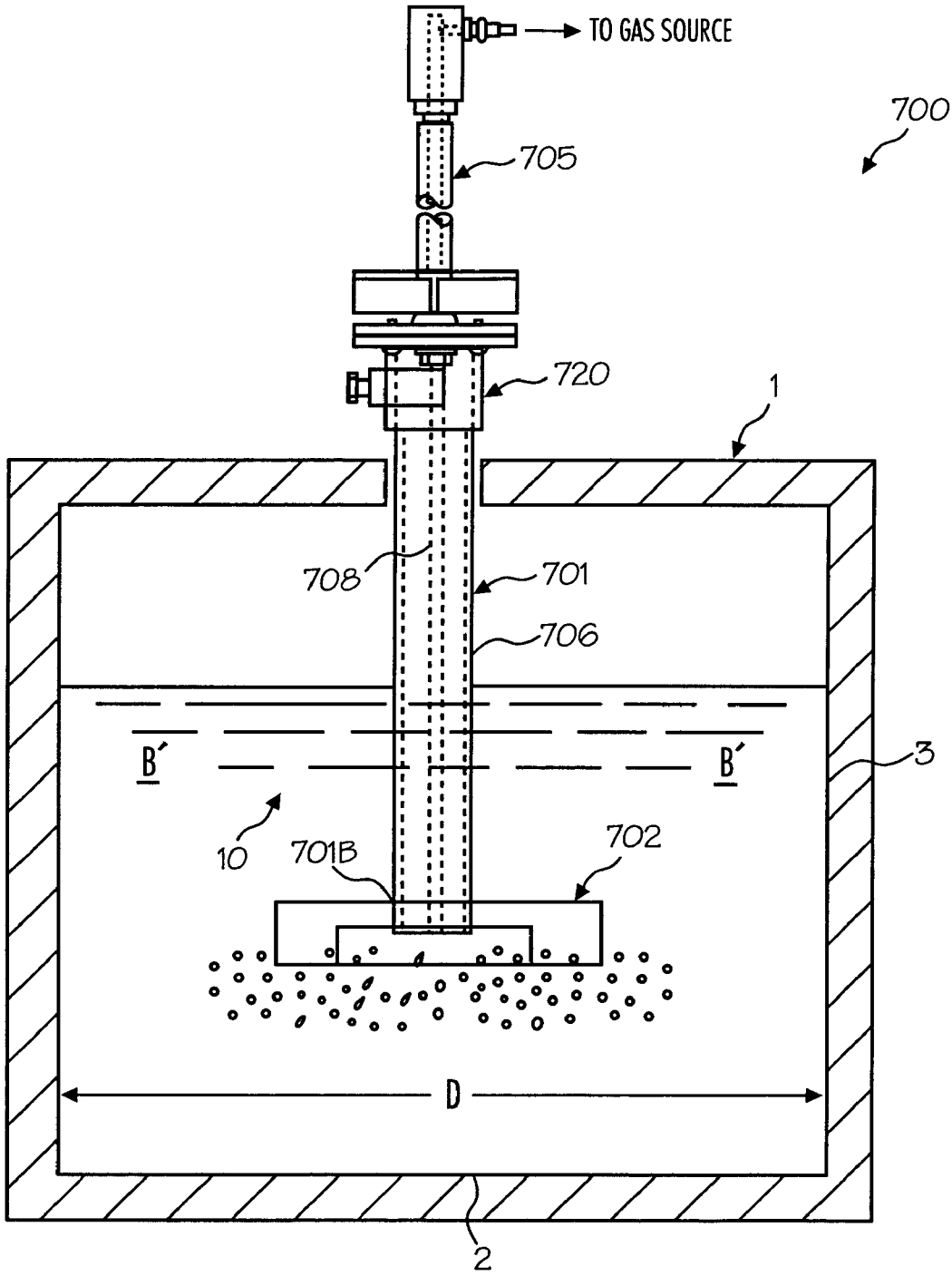
FIG. 10 shows a rotary degasser including one or more coated components according to the invention.

FIG. 10 shows a preferred gas-release device 700 according to the invention. Device 700 is designed to operate in a molten metal bath B' contained within a vessel 1. Device 700 is preferably a rotary degasser and includes a shaft 701, an impeller 702 and a drive source (not shown). Device 700 preferably also includes a drive shaft 705 and a coupling 720. Shaft 701 and impeller 702 are preferably made of graphite impregnated with an oxidation-resistant solution. Shaft 701 may include a protective coating (as described herein) and impeller 702 may also be entirely or partially covered with a protective coating.

Preferred device 700 is described in greater detail in U.S. patent application Ser. No. 09/569,461 to Cooper entitled "Molten Metal Degassing Device," the disclosure of which is incorporated herein by reference. Coupling 720 for use in device 700 is described in U.S. Pat. No. 5,678,807, the disclosure of which is incorporated herein by reference. The drive source may be an electric, pneumatic or hydraulic motor although the drive source may be any device or devices capable of rotating impeller 702.

Figure 11:
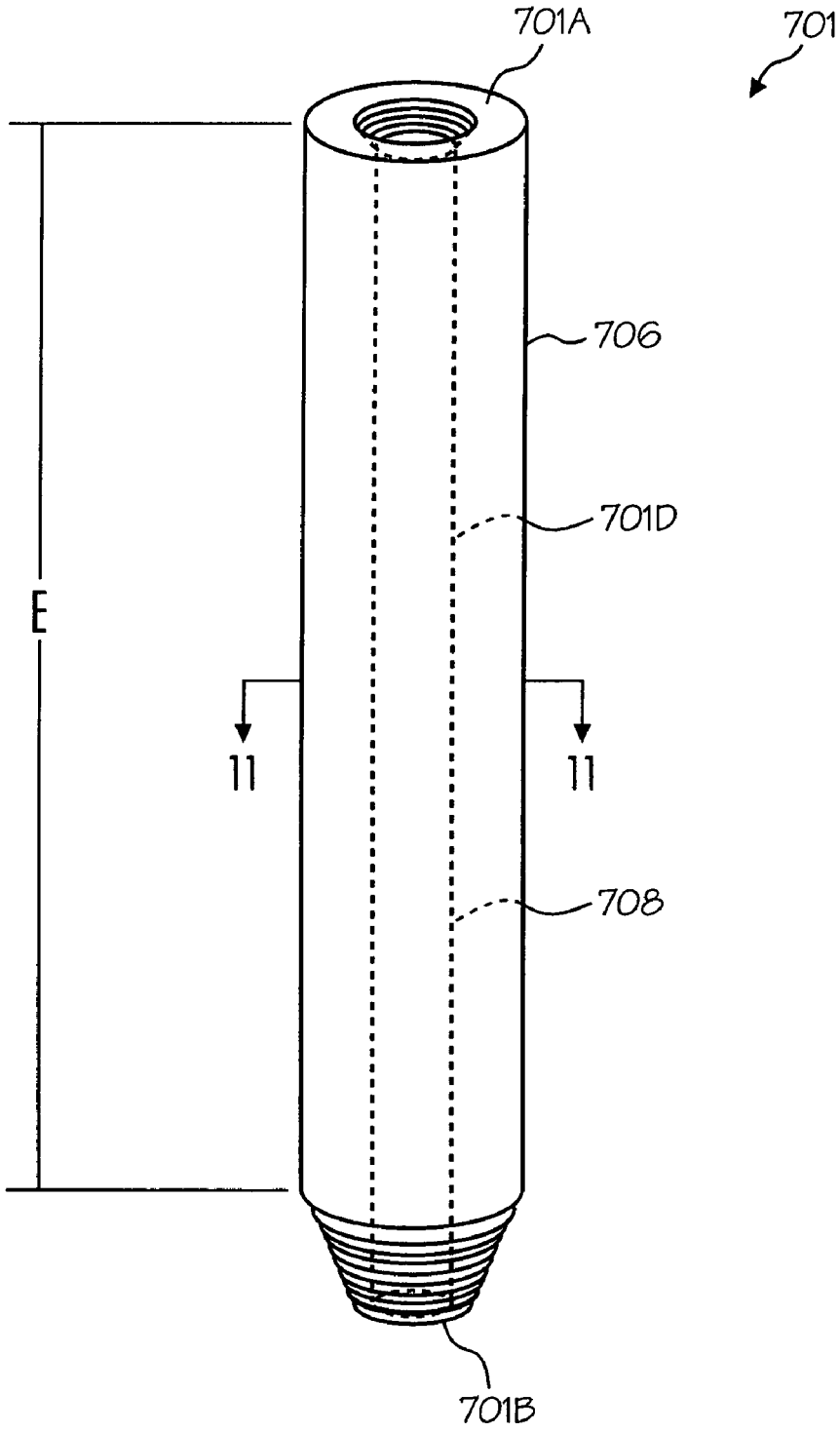
FIG. 11 is an elevational view of the shaft of the degasser of FIG. 10.

As is illustrated in FIGS. 10 and 11, shaft 701 has a first end 701A, a second end 701B, a side 706 and an inner passage 708 for transferring gas. End 701B preferably has a structure, such as the threaded end shown, for connecting to an impeller. Shaft 701 may be a unitary structure or may be a plurality of pieces connected together. The purpose of shaft 701 is to (1) connect to impeller 702 in order to rotate the impeller, and (2) transfer gas into the molten metal bath. Any structure capable of performing these functions can be used.

Figure 12:
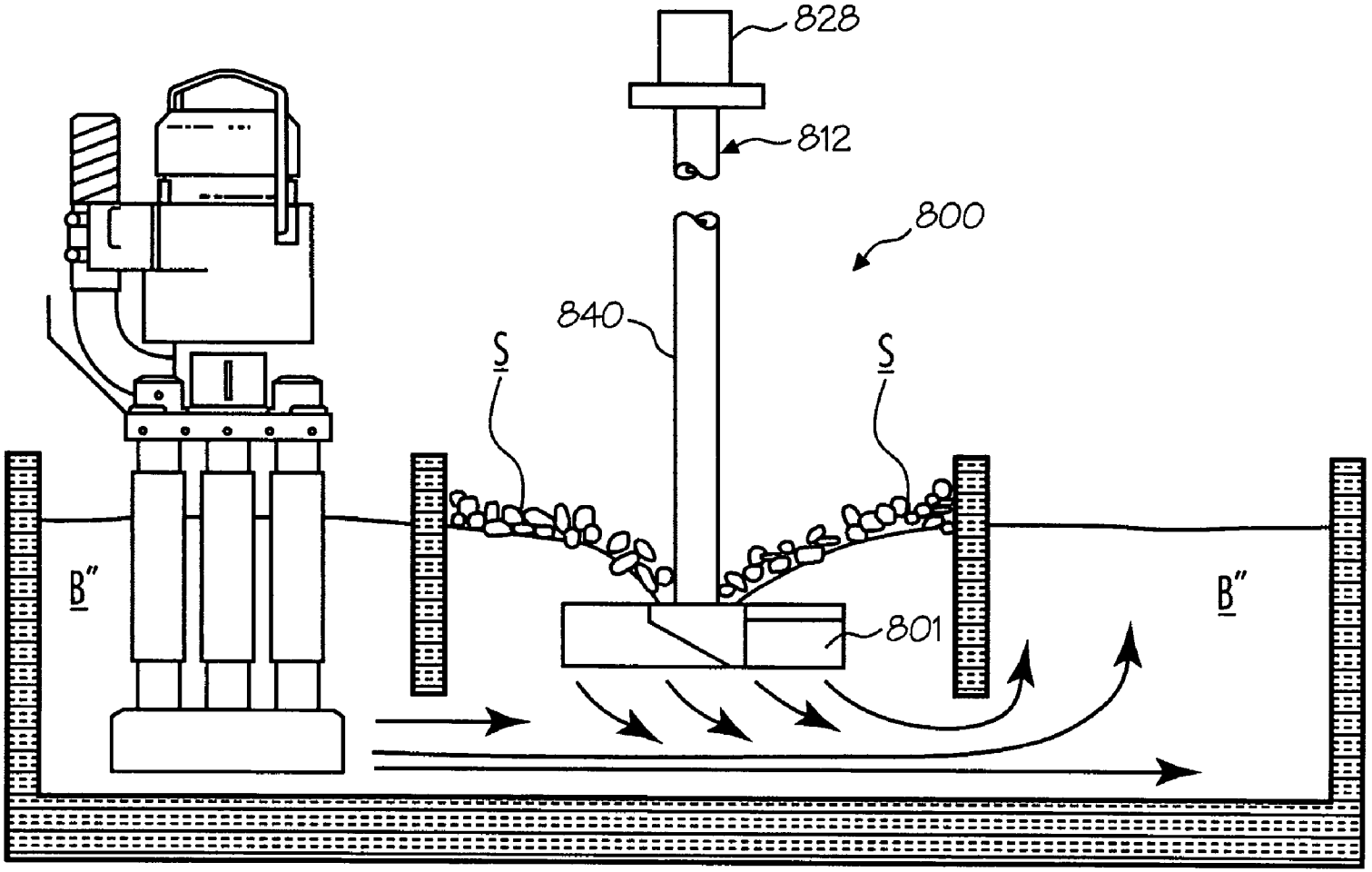
FIG. 12 shows a scrap melter according to the invention.
Figure 13:
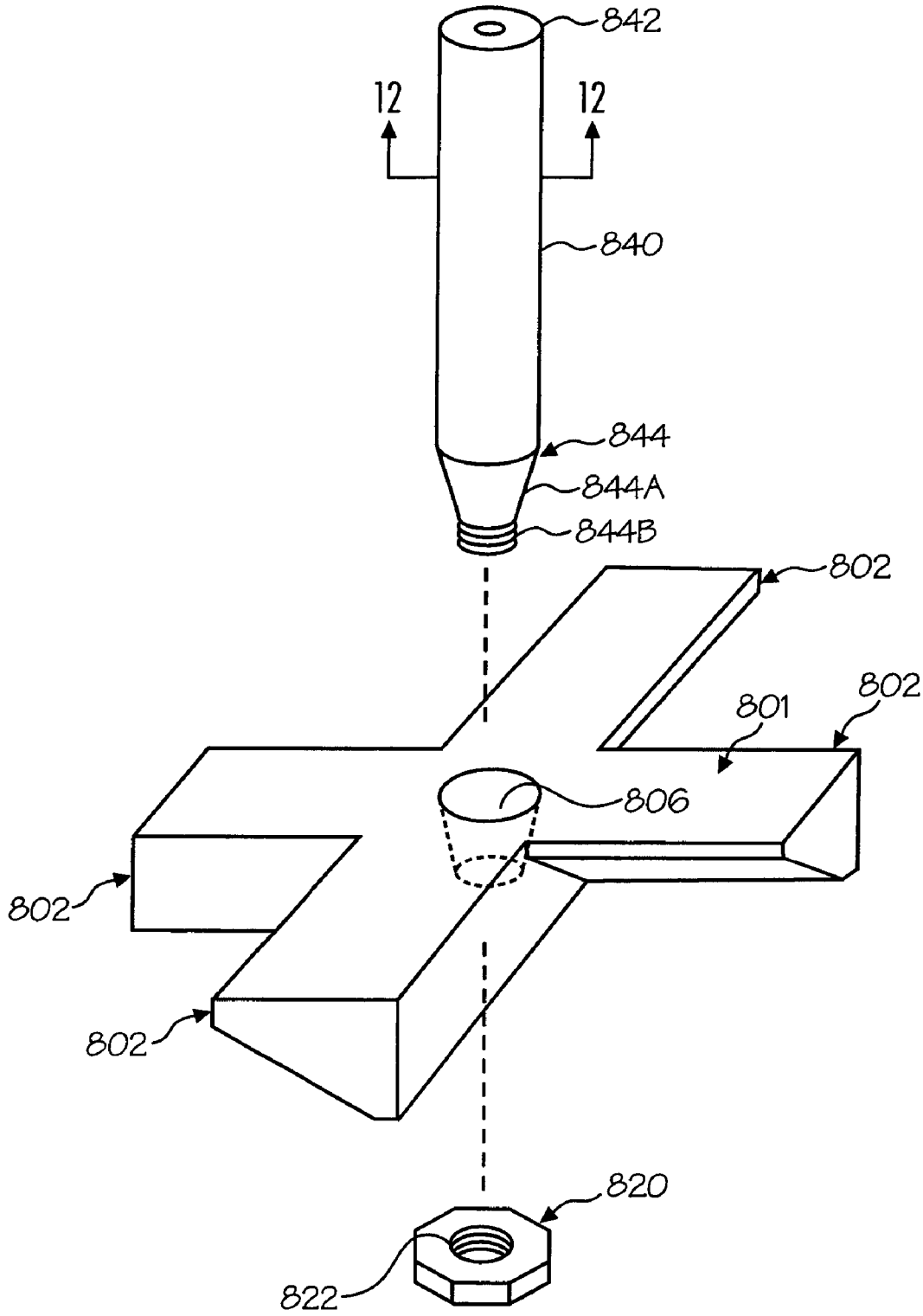
FIG. 13 shows the shaft and impeller of the scrap melter of FIG. 12.

Preferred scrap melters that may be used to practice the invention are shown in U.S. patent application Ser. No. 09/049,190 to Cooper, filed Aug. 28, 2000, U.S. Pat. No. 4,598,899 to Cooper and U.S. Pat. No. 4,930,986 to Cooper. FIGS. 12 and 13 show a scrap melter 800. All of the components of scrap melter 800 exposed to molten metal bath B" are preferably formed from oxidation-resistant graphite or other material suitable for use in molten metal. Further, at least the rotor shaft may be entirely or partially covered with a protective coating, as described herein. The rotor may also be entirely partially covered with a protective coating.

A drive source 828 is connected to impeller 801 by any structure suitable for transferring driving force from source 828 to impeller 801. Drive source 828 is preferably an electric, pneumatic or hydraulic motor, although the term drive source may be any device or devices capable of rotating impeller 801.

A drive shaft 812 is preferably comprised of a motor drive shaft (not shown) connected to an impeller drive shaft 840. The motor drive shaft has a first end and a second end, the first end being connected to motor 828 by any suitable means and which is effectively the first end of drive shaft 812 in the preferred embodiment. An impeller shaft 840 has a first end 842 (shown in FIG. 13) and a second end 844. The preferred structure for connecting the motor drive shaft to impeller drive shaft 840 is a coupling (not shown). The coupling preferably has a first coupling member and a second coupling member. The first end 842 of impeller shaft 840 is connected to the second end of the motor shaft, preferably by the coupling, wherein the first end 842 of impeller shaft 840 is connected to the second coupling member and the second end of the motor drive shaft is connected to the first coupling member. The motor drive shaft drives the coupling, which, in turn, drives impeller drive shaft 840. Preferably, the coupling and first end 842 of the impeller shaft 840 are connected without the use of connecting threads.

Impeller 801 is an open impeller. The term "open" used in this context refers to an impeller that allows dross and scrap to pass through it, as opposed to impellers such as the one shown in U.S. Pat. No. 4,930,986, which does not allow for the passage of much dross and scrap, because the particle size is often too great to pass through the impeller. Preferred impeller 801 is best seen in FIG. 13. Impeller 801 provides a greater surface area to move molten metal than conventional impellers, although any impeller suitable for use in a scrap melter may be used. Impeller 801 may, for example, have a perforate structure (such as a bird-cage impeller, the structure of which is known to those skilled in the art) or partially perforate structure, and be formed of any material suitable for use in a molten metal environment. Impeller 801 is preferably imperforate, has two or more blades, is attached to and driven by shaft 812 (by being attached to shaft 840 in the preferred embodiment), and is preferably positioned centrally about the axis of shaft 840.

The non-coated components of the molten metal devices exposed to the molten metal are preferably formed of structural refractory materials, which are resistant to degradation in the molten metal. Carbonaceous refractory materials, such as carbon of a dense or structural type, including graphite, graphitized carbon, clay-bonded graphite, carbon-bonded graphite, or the like have all been found to be most suitable because of cost and ease of machining. Such non-coated components may be made by mixing ground graphite with a fine clay binder, forming the non-coated component and baking, and may be glazed or unglazed. In addition, non-coated components made of carbonaceous refractory materials may be treated with one or more chemicals to make the components more resistant to oxidation. Oxidation and erosion treatments for graphite parts are practiced commercially, and graphite so treated can be obtained from sources known to those skilled in the art. The non-coated components may then be subjected to machining operations.

While non-coated components are often formed from carbonaceous materials, such materials corrode and wear during normal use and must be replaced. Further, non-coated components exposed at the surface of the molten metal bath are especially subject to oxidation that occurs when oxygen and the molten metal interact. It is therefore advantageous to place a protective coating on these non-coated components in order to extend their life.

The preferred protective coating according to one aspect of the invention is a sleeve or cover, preferably formed of a ceramic and most preferably of nitride-bonded silicon carbide. But other suitable, oxidation resistant materials may be used, such as aluminum oxide or other ceramics. This protective coating differs from prior-art coatings primarily in the manner in which it is applied to a non-coated component. Generally, the process comprises the steps of first positioning a protective coating on a non-coated component (which may be done utilizing a mold or other device to position the protective coating on the non-coated component and to hold the two steady), placing the protective coating on the non-coated component and inside the mold (if a mold is used), there being a space between the non-coated component and the protective coating, and injecting uncured refractory into the space, allowing the refractory to cure, and removing the finished, protected component including the protective coating from the mold. No mold need be used, but a mold is preferred to support the non-coated component and protective coating. Further, the mold may remain on the protected component. Depending on its composition, the mold may dissolve or incinerate when the protected component is placed in molten metal.

A mold is any structure that can surround, cover and/or encapsulate at least part of a non-coated component. A mold may be of any suitable shape or size and made of any material suitable for entirely or partially surrounding, covering and/or encapsulating the non-coated component and holding it secure while cement is injected into the space between the mold and the non-coated component. Preferably, the mold is plaster of paris, plastic, or thick cardboard, although any suitable material could be used. A mold may also be used to hold a protective coating and non-coated component in position while cement is injected into the space between the two.

A non-coated component could be any of the components for use in molten metal previously described herein, or similar components, prior to having a protective coating according to the invention applied. Such a non-coated component may have some uncured cement applied to it before the protective coating is placed on it.

"Cured" cement means that the cement has become sufficiently hardened to secure the protective coating to the non-coated component. In the preferred embodiment, the cement cures by drying at room temperature, although any suitable method for curing (such as hot air) may be used.

"Injection" means any suitable method for inserting or placing uncured cement into the space. In the preferred embodiment, uncured cement is injected using pneumatic injection device at room temperature.

Figure 1A:
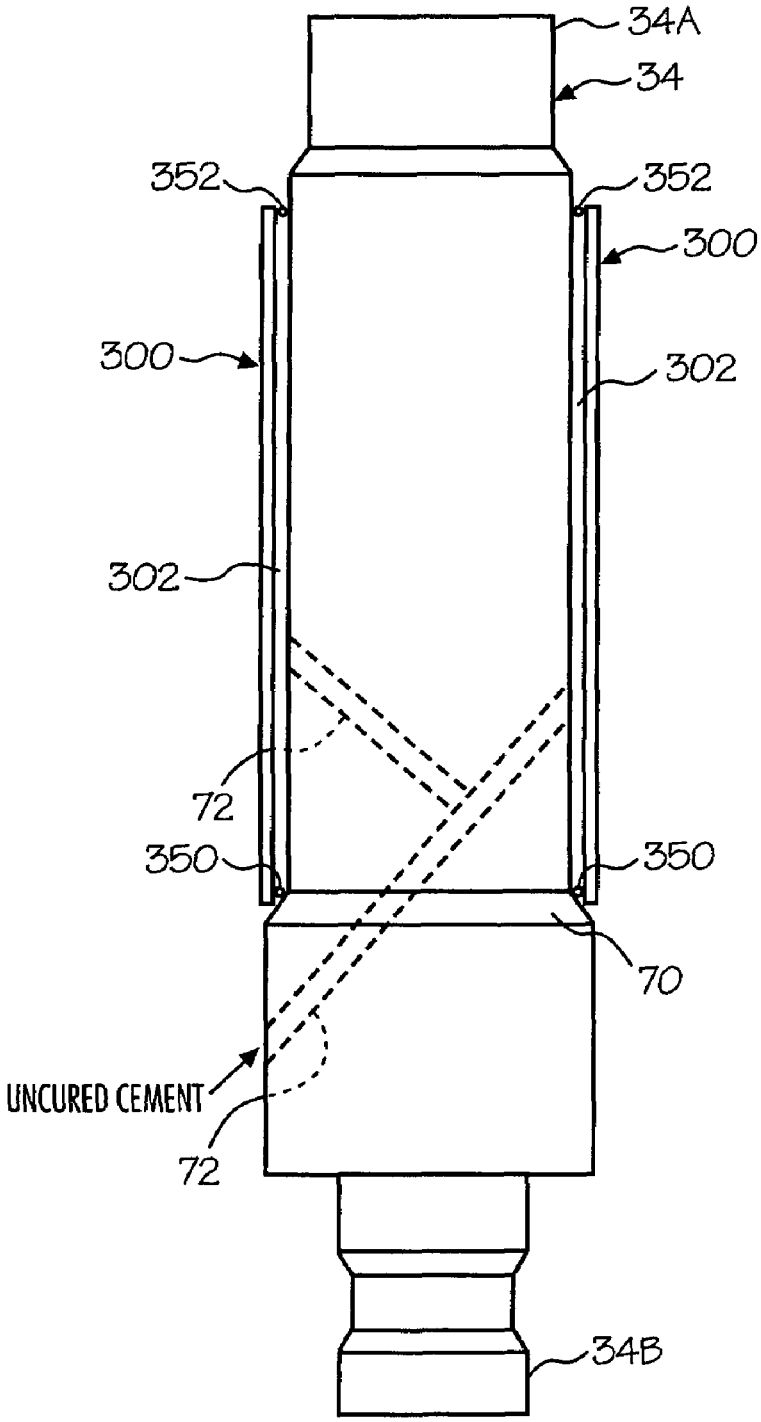
FIG. 1A is a cross-sectional view of a protective coating positioned on a non-coated component.

The preferred embodiment, illustrated generally in FIG. 1A, utilizes a pneumatic pressure vessel to inject uncured cement. Air pressure is applied to the vessel by an approximately 4" I.D. plastic tube, which is connected to an air source. A tube or cylinder of cement is placed within the vessel and the air pressure preferably forces a surface into contact with the top of the tube, forcing cement out of the bottom and into an approximately ½" I.D. plastic tube. The cement is forced through the ½" I.D. tube and into passages 72 in non-coated component 34 and into space 302.

Placing the non-coated component into a mold means any method for placing the non-coated component into the mold, or placing the mold on or around all or part of the non-coated component. Placing a protective coating on the non-coated component means any method of placing a protective coating onto a non-coated component or placing a non-coated component into a protective coating.

An example of the process of the invention is shown in FIG. 1A, which is a cross-sectional view of protective coating 300 positioned on a support post 34 of a molten metal pump. In this embodiment, protective coating 300 is a sleeve placed onto the circumference of a length of post 34 that will be directly exposed to molten metal, including the surface of bath B. In this embodiment, protective coating 300 is cylindrical and surrounds post 34. Protective coating 300 may be a unitary cylindrical piece, and be inserted on post 34 from end 34A, or protective coating 300 may be sectional, wherein the sections are fitted around post 34, and are joined, either mechanically or adhesively (for example, by using cement).

Upper section 34A of post 34 is for attachment to a post clamp 35 on superstructure 36 and base 34B is for attachment to base 24. A beveled surface 70 is preferably formed on post 34 (or any vertical member coated with a protective coating according to the invention). Beveled surface 70 is optional and performs the function of locating (i.e., positioning) and supporting protective coating 300 and providing a surface for mounting an optional gasket 350. Gasket 350 can be any gasket capable of creating a seal between protective coating 300 and post 34. Any structure or device, however, capable of creating a seal and preventing a large amount of uncured coating from seeping through any gap between protective coating 300 and post 34 may be used, or no device need be used if the fit between protective coating 300 and a non-coated component is sufficient to prevent substantial leakage of uncured cement. A second gasket 352 may be placed at the top of protective coating 300, around post 34.

In the preferred embodiment, uncured cement is injected into space 302 through channels (or passages) 72 formed in post 34. Alternatively, uncured cement may be injected through openings in protective coating 300, through an opening between protective coating 300 and post 34, or through any combination of these injection methods.

The cement is then allowed to cure to adhere the protective coating to the non-coated component, thus forming a protected component. The protective coating may be applied to any section or part of any non-coated component, or cover any non-coated component entirely, may be of any thickness and may or may not be a uniform thickness.

Another method of applying a protective coating is direct casting whereby refractory is placed into a mold containing the non-coated component such that the refractory comes in contact with at least part of the outer surface of the non-coated component. As it dries the refractory adheres to the non-coated component becomes a protective coating. In this case the coating is called a refractory coating. This method can be performed in the same manner as previously described, except that there is no separate protective coating and the space filled by the uncured refractory is the space between the mold and the non-coated component. Once the refractory hardens, the mold is removed and the protected component comprises the non-coated component covered at least in part by a refractory coating.

Figure 4:
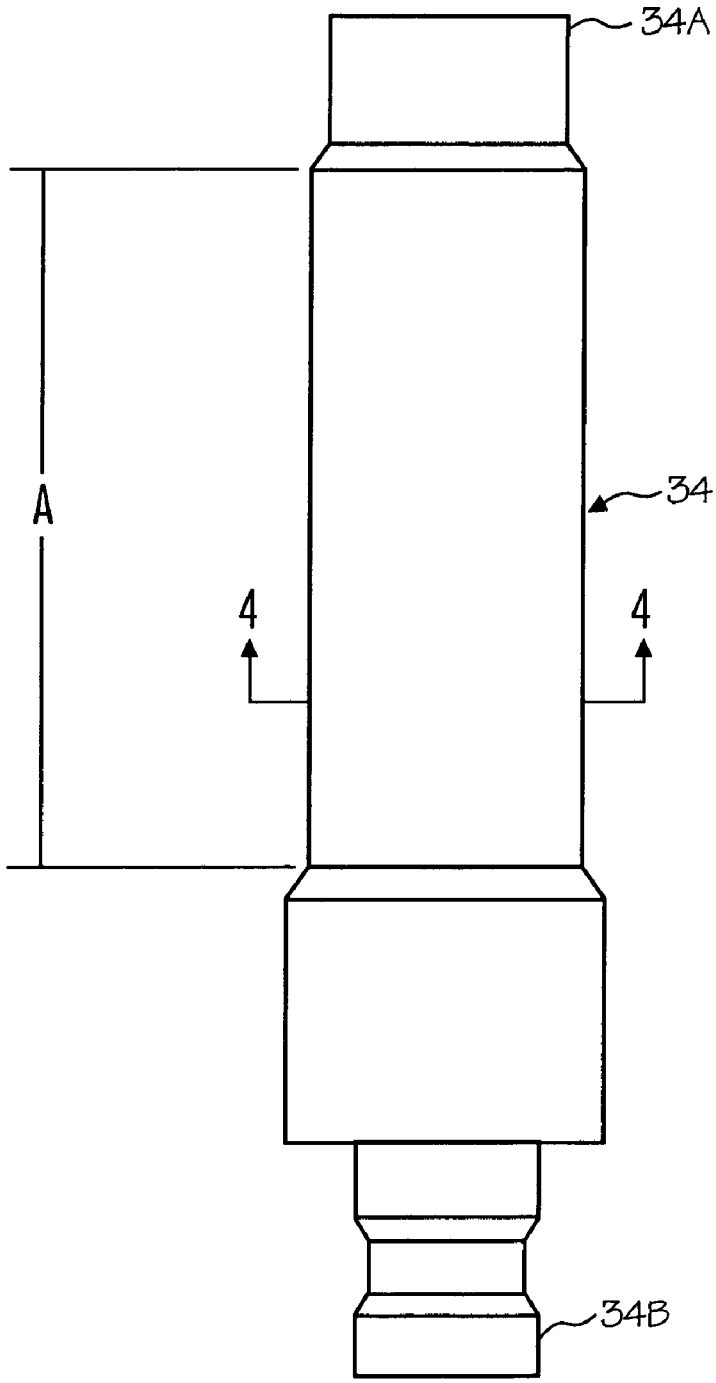
FIG. 4 is a front view of a support post having a protective coating according to the FIG. 4A is a cross-sectional view of the support post of FIG. 4 taken along lines 4-4.
Figure 4A:
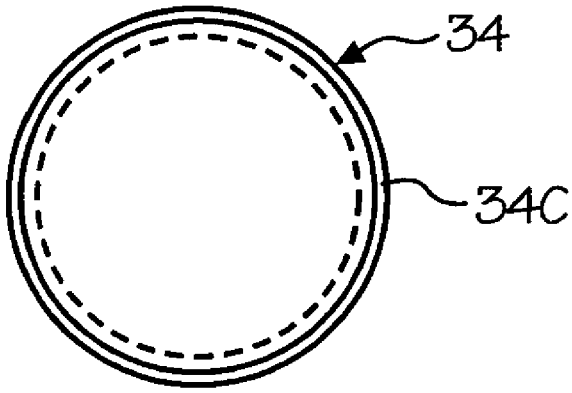
Figure 5:
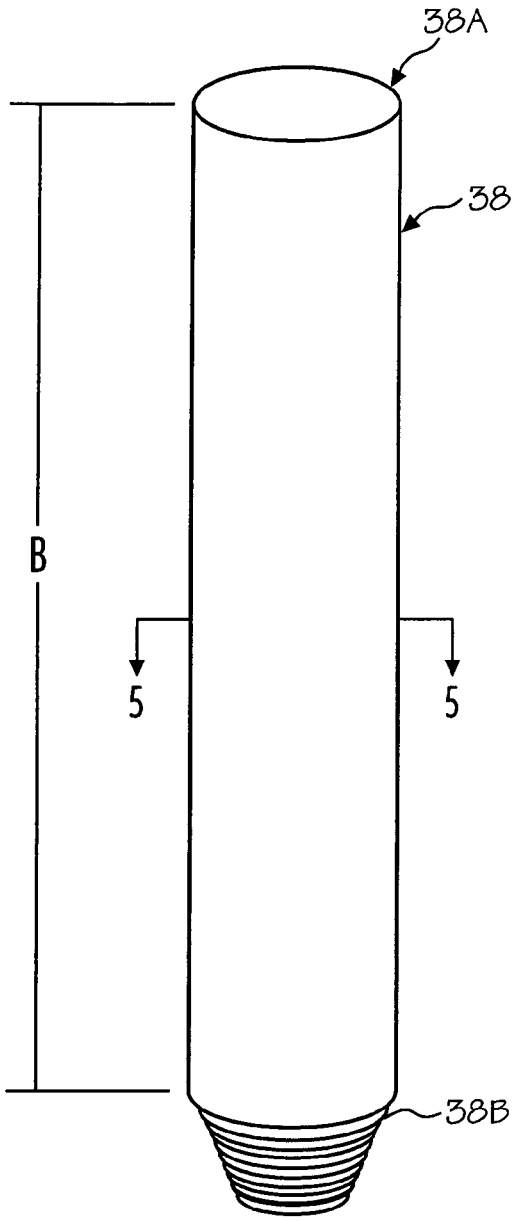
FIG. 5 is a perspective view of a rotor shaft having a protective coating according to the invention.
Figure 6:
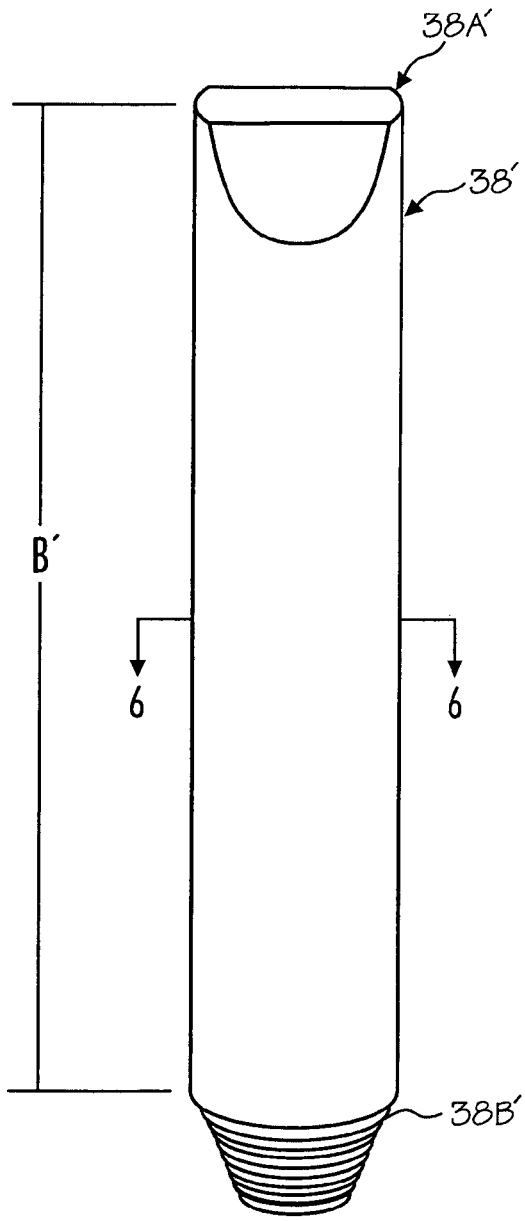
FIG. 6 is a perspective view of a rotor shaft having a top (or first) end with two opposing flat surfaces and two opposing curved surfaces.
Figure 5A:
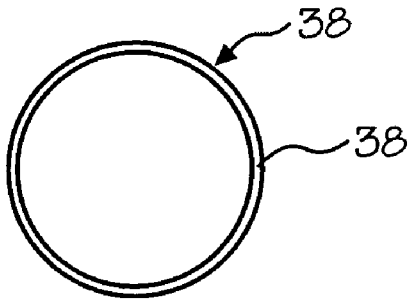
FIG. 5A is a cross-sectional view of the rotor shaft of FIG. 5 taken along lines 5-5.
Figure 6A:
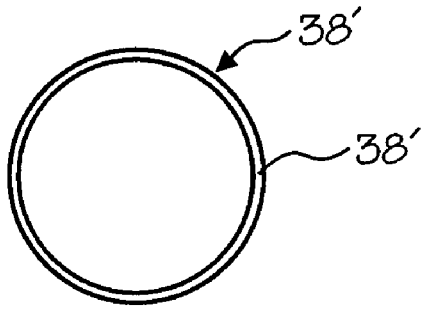
FIG. 6A is a cross-sectional view of the rotor shaft of FIG. 6 taken along lines 6-6.
Figure 7:
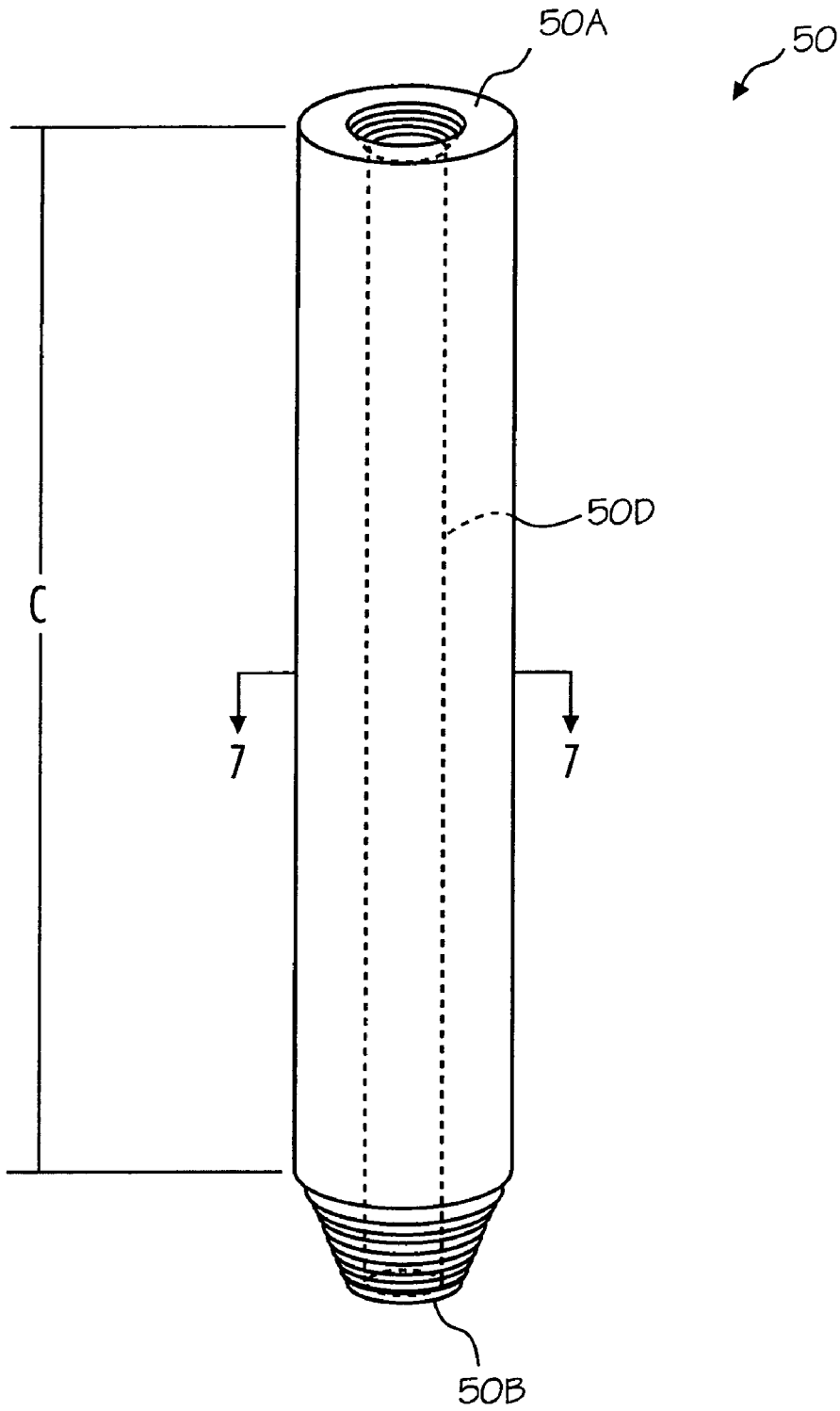
FIG. 7 is a front view of a metal-transfer conduit having a protective coating according to the invention.
Figure 7A:
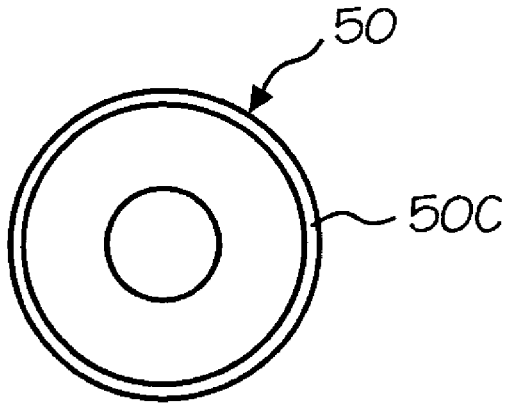
FIG. 7A is a cross-sectional view of the metal-transfer conduit of FIG. 7 taken along lines 7-7.
Figure 8:
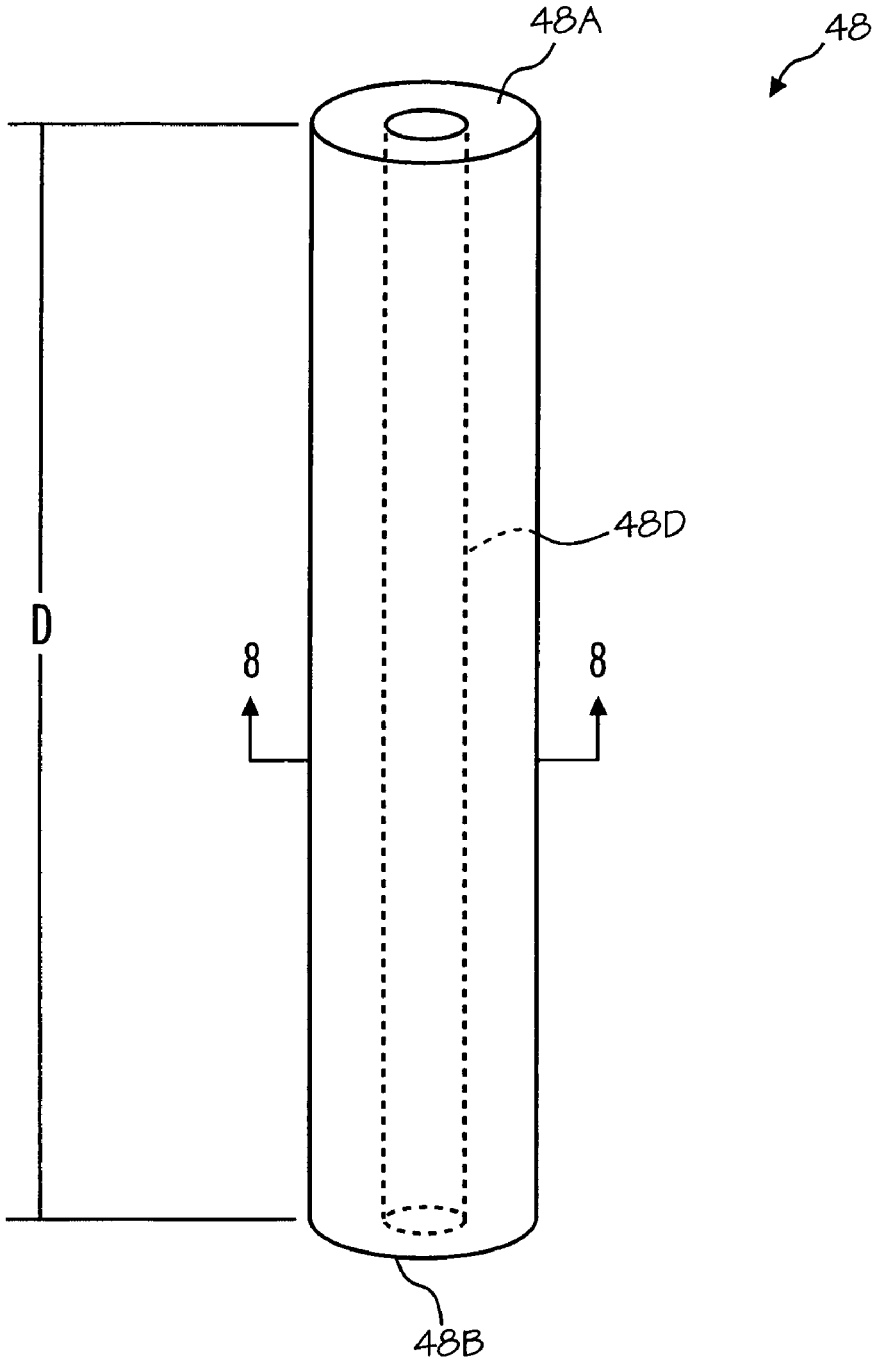
FIG. 8 is a perspective view of a gas-transfer conduit having a protective coating according to the invention.
Figure 8A:
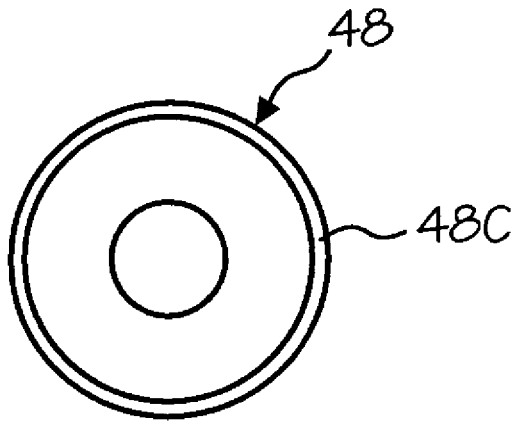
FIG. 8A is a cross-sectional view of the gas-transfer conduit of FIG. 8 taken along lines 8-8.
Figure 9:
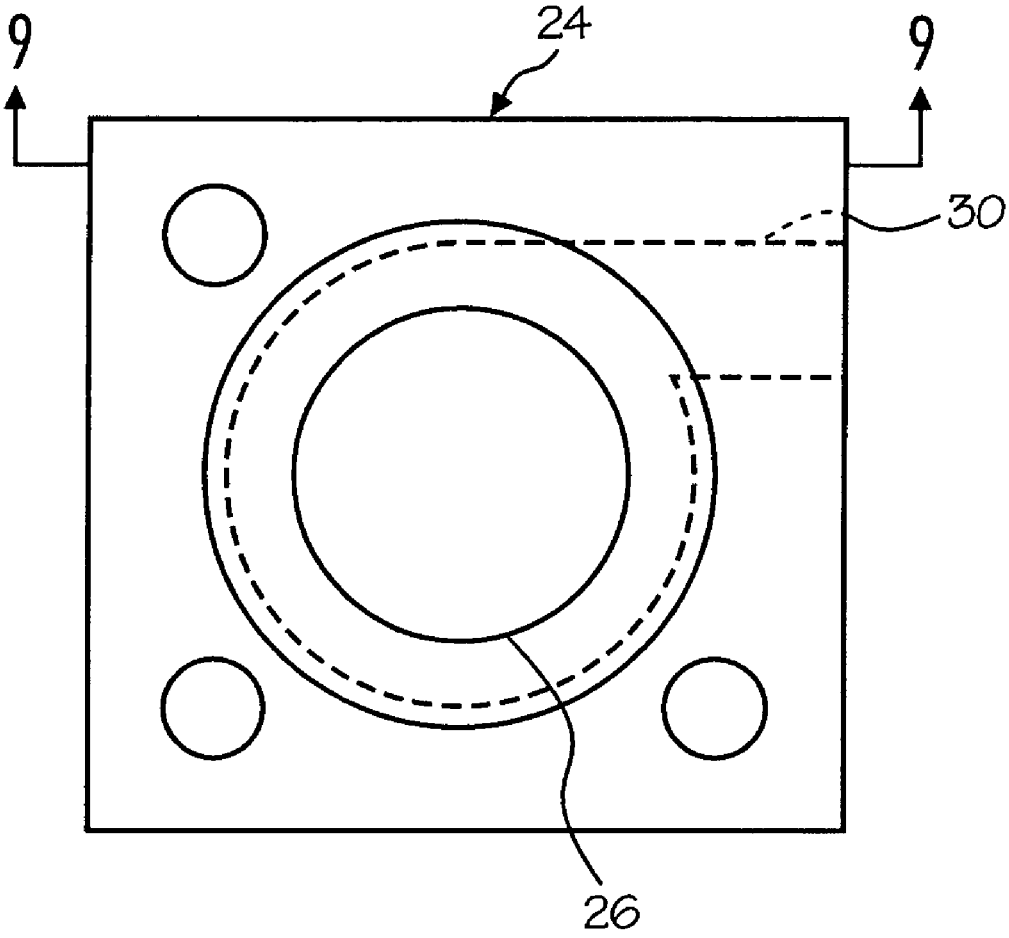
FIG. 9 is a top view of a pump casing having a protective coating according to the invention.
Figure 9A:
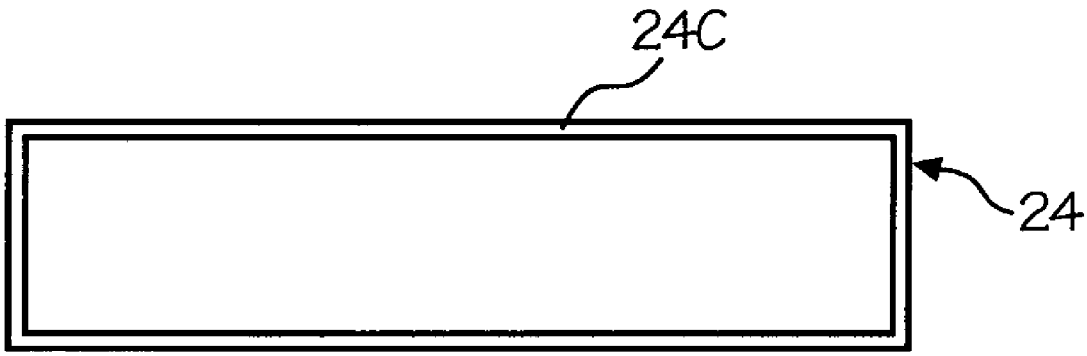
FIG. 9A is a cross-sectional view of the pump casing of FIG. 9 taken along lines 9-9.
Figure 11A:
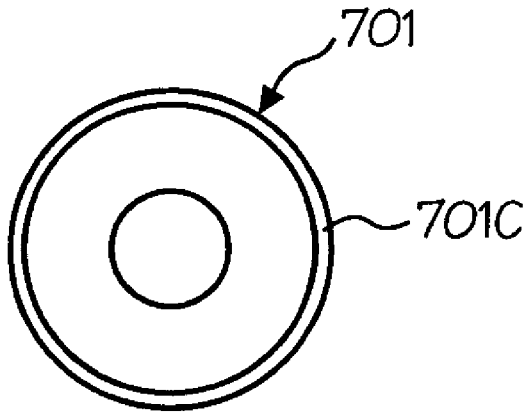
FIG. 11A is a cross-sectional view of the shaft of FIG. 11 taken along lines 11-11.
Figure 14:
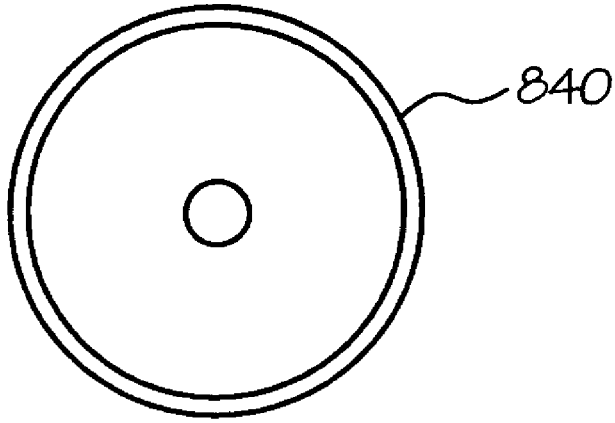
FIG. 14 is a cross-sectional view of the shaft of FIG. 13 taken along lines 12-12.

Any component of a molten metal pump, scrap melter or rotary degasser may be a protected component according to the invention. FIGS. 4 and 4A show a support post 34 having a coating 34C according to the invention. Coating 34C preferably extends along length A of support post 34, but can cover any or all of support post 34. FIGS. 5 and 5A depict a rotor shaft 38 (that can be used with a molten metal pump or a scrap melter) having a coating 38C according to the invention. Coating 38C preferably extends along length B of rotor shaft 38, but can cover any or all of rotor shaft 38. FIGS. 6 and 6A show an alternate rotor shaft 38 (that can be used with a molten metal pump or a scrap melter) having a coating 38C' according to the invention. Coating 38C" preferably extends along length B' of rotor shaft 38', but can cover any or all of rotor shaft 38. FIGS. 7 and 7A show a gas-transfer conduit 50 for use with a gas-release pump (not shown) or other gas-release device (not shown). Conduit 50 has a coating 50C according to the invention. Coating 50C preferably extends along length C of metal-transfer conduit 50, but can cover any or all of metal-transfer conduit 50. FIGS. 8 and 8A show a metal-transfer conduit 48 for use with a transfer pump (not shown) having a coating 48C according to the invention. Coating 48C preferably extends along length D of gas-transfer conduit 48, but can cover any or all of gas-transfer conduit 48. FIGS. 9 and 9A show a pump base 24 having a coating 24C according to the invention. Base 24 has an external surface 25 that is preferably entirely covered with coating 24C. Coating 24C may, however, cover any or all of base 24. FIGS. 11 and 11A show a rotor shaft 701 for use with a rotary degasser. Rotor shaft 701 has a coating 701C that preferably extends along length E, but protective coating 701C can cover any or all of rotor shaft 701. FIGS. 13 and 14 show a rotor shaft 840 of scrap melter 800. Coating 840C preferably extends along length E of shaft 840, but can cover any or all of shaft 840.

Figure 1B:
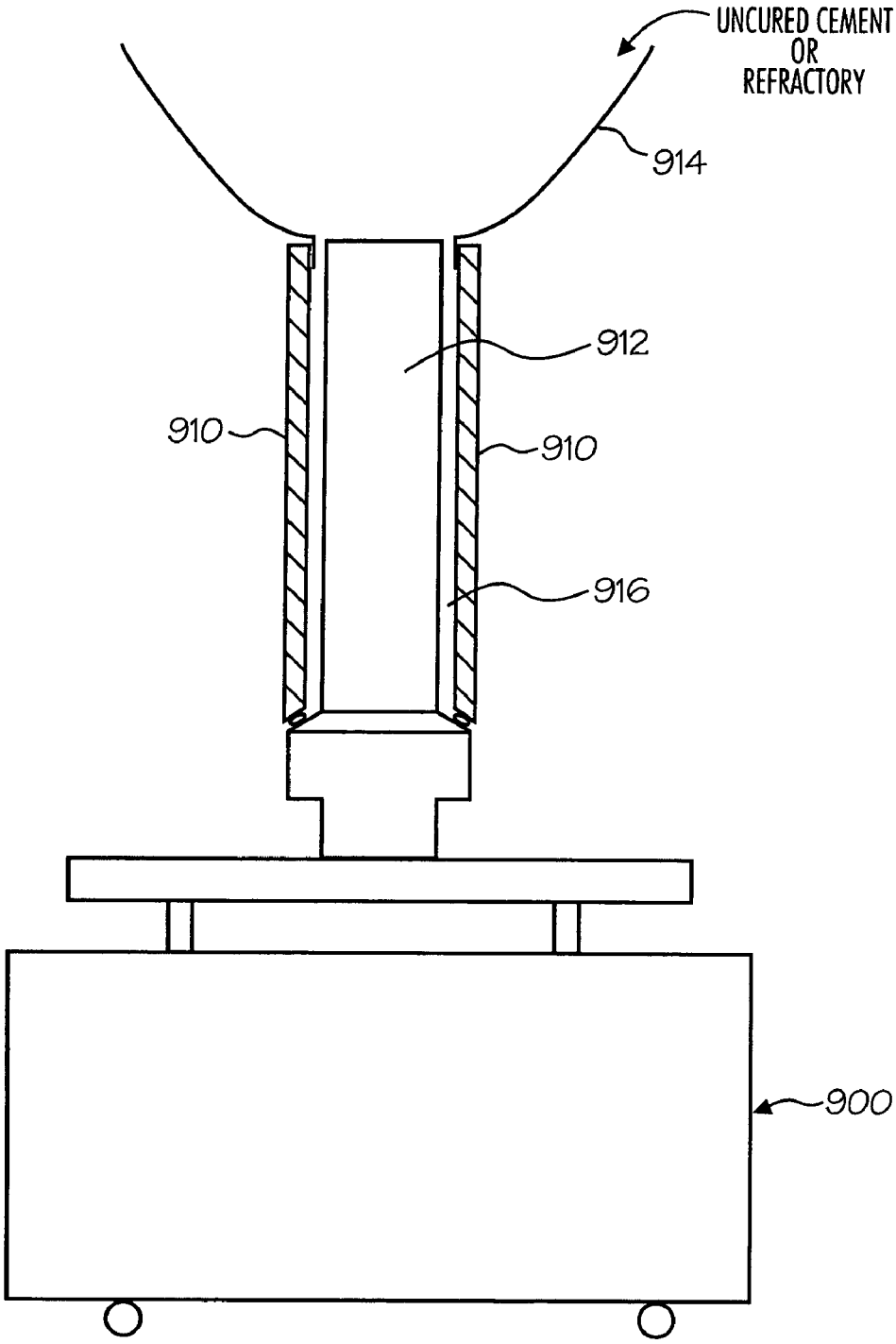
FIG. 1B is a front view of a vibrating table according to the invention.
Figure 1C:
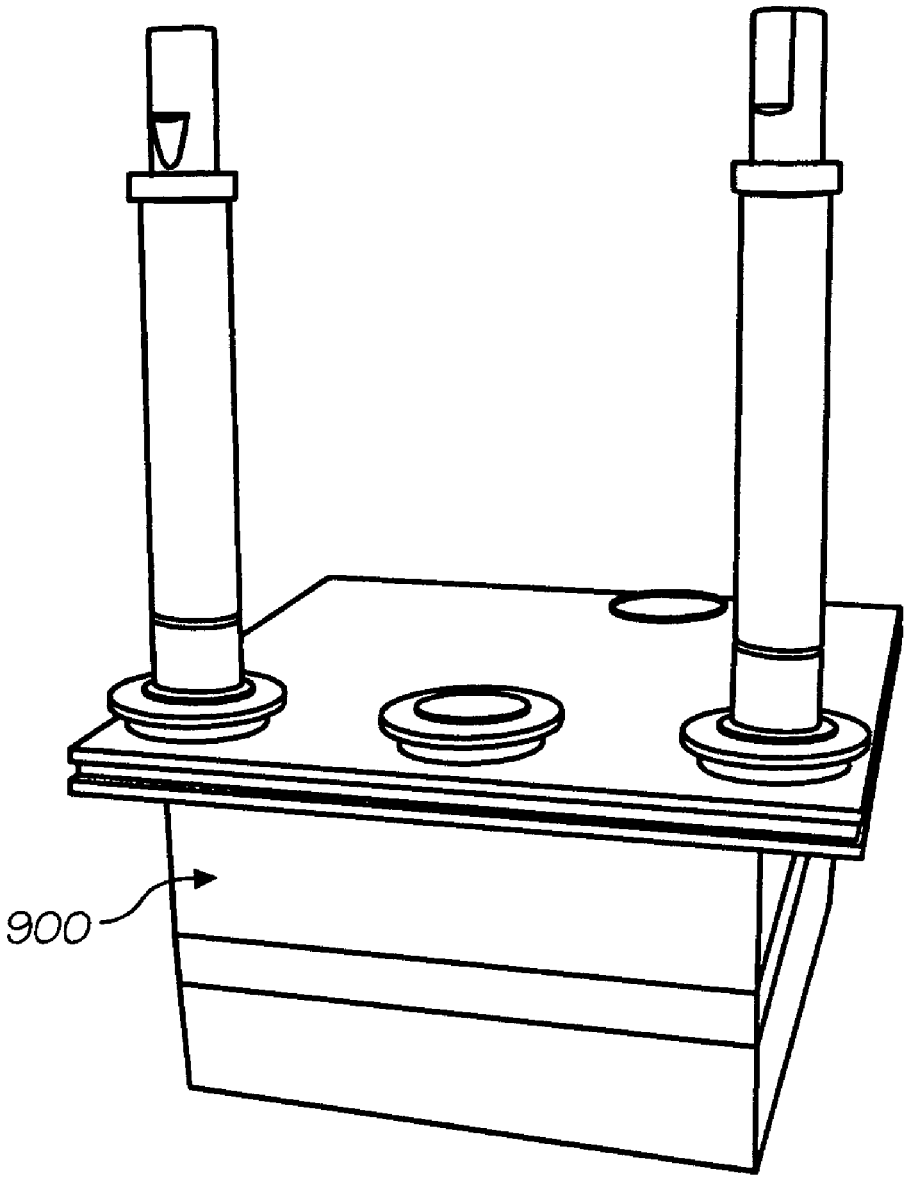
FIG. 1C is a view of one embodiment of a working model of the table depicted in FIG. 1B.

A component according to the first or second method described herein may be formed using a vibratory table 900, as shown in FIGS. 1B and 1C. Utilizing a method according to the invention, a non-coated component 912 is placed on vibratory table 900 and a mold 910 is preferably placed partially or completely around non-coated component 912. As shown, the non-coated component is a support post, but it could be any non-coated component for use in a molten metal bath. An optional funnel 914 is placed above mold 910 in order to direct uncured refractory into space 916 between mold 910 and non-coated component 912, or to direct uncured cement into the space between a protective coating (not shown) and non-coated component 912.

In operation, vibratory table 900 (which can be any type of vibratory table or vibratory device) is activated and uncured cement or refractory is placed in funnel 914. As table 900 vibrates, the uncured cement or refractory fills space 916 between mold 910 and non-coated component 912 or non-coated component 912 and the protective coating (not shown). The cement is then allowed to cure to adhere the protective coating to the non-coated component 912 or the refractory is allowed to cure to form a refractory coating on non-coated component 912. Alternatively, any system or method for vibrating the mold and/or non-coated component and/or protective coating may be used, as long as the method or system assists in filling the space with cement or refractory.

Having thus described different embodiments of the invention, other variations and embodiments that do not depart from the spirit of the invention will become apparent to those skilled in the art. The scope of the present invention is thus not limited to any particular embodiment, but is instead set forth in the appended claims and the legal equivalents thereof.

Unless expressly stated in the written description or claims, the steps of any method recited in the claims may be performed in any order capable of yielding the desired product.

What is claimed is:

1. A protected component for use in a molten metal bath, the protected component including a non-coated component and a protective coating and made by the process of: (a) placing a protective coating on a non-coated component, wherein a space exists between the non-coated component and the protective coating; (b) injecting uncured cement into the space wherein at least some of the uncured cement is injected into the space through either one or more channels in the non-coated component or one or more openings in the protective coating; and (c) allowing the uncured cement to cure, thus adhering the non-coated component to the protective coating.

2. The protected component of claim 1 wherein at least some of the uncured cement is injected into the space through a channel in the non-coated component.

3. The protected component of claim 1 wherein at least some of the uncured cement is injected into the space through an opening in the protective coating.

4. The protected component of claim 1 wherein the protective coating is positioned on the non-coated component by a beveled lip formed on the non-coated component.

5. The protected component of claim 4 wherein there is a gasket between the beveled lip and the protective coating.

6. The protected component of claim 1 wherein a gasket is positioned between the protective coating and the non-coated component.

7. The protected component of claim 1 wherein the non-coated component is comprised of graphite.

8. The protected component of claim 1 wherein the protective coating covers only part of the non-coated component.

9. The protected component of claim 1 wherein the component is a support post.

10. The protected component of claim 1 wherein the protective coating is comprised of ceramic.

11. The protected component of claim 10 wherein the protective coating is comprised of one or more of the group consisting of nitride-bonded silicon carbide and aluminum oxide.

12. The protected component of claim 1 wherein the non-coated component is centered inside the protective coating.

13. The protected component of claim 1 wherein the protective coating has a uniform thickness.

14. The protected component of claim 1 which is a rotor shaft.

15. The protected component of claim 1 which is a support post for a molten metal pump.

16. The protected component of claim 1 which is a conduit for at least one of molten metal and gas.

17. The protected component of claim 1 which is a pump base for a molten metal pump.

18. The protected component of claim 1 which is a rotor for a molten metal pump.

19. A device for pumping or otherwise conveying molten metal, the device including: (a) a superstructure supporting a drive source; (b) a drive shaft having a first end and a second end, the first end connected to the drive source; (c) a pump base including an inlet, a pump chamber, and a discharge; (d) one or more support posts connecting the pump base to the superstructure; and (e) an impeller attached to the second end of the drive shaft, the impeller positioned at least partially within the pump chamber; wherein one or more of the group consisting of: the drive shaft, the pump base, the one or more support posts and the impeller is a protected component according to claim 1.

20. The device of claim 19 wherein the drive shaft comprises: (a) a motor shaft having a first end and a second end, the first end connected to the drive source; (b) a coupling having a first coupling member and a second coupling member, the first coupling member connected to the second end of the motor shaft, and (c) a rotor shaft having a first end and second end, the first end of the rotor shaft connected to the second coupling member and the second end of the rotor shaft connected to the rotor.

21. The device of claim 19 that further includes a gas-transfer conduit having a first end connected to a gas source and a second end for releasing gas into molten metal.

22. The device of claim 21 wherein the gas-transfer conduit is a protected component according to claim 1.

23. The device of claim 19 that further includes a metal-transfer conduit downstream of the discharge.

24. The device of claim 23 wherein the metal-transfer conduit is a protected component according to claim 1.

25. The device of claim 23 that further includes a gas-transfer conduit having a first end connected to a gas source and a second end for releasing gas into molten metal.

26. The device of claim 19 wherein each protected component includes a non- coated component comprised of graphite.

27. The device of claim 26 wherein each protected component includes a protective coating comprising a material selected from one or more of the group consisting of nitride-bonded silicon carbide and aluminum oxide.

28. The device of claim 19 wherein the non-coated component of each protected component is only partially covered with the protective coating.

29. The device of claim 19 wherein the rotor shaft is a protected component according to claim 1.

30. The device of claim 19 wherein one of the one or more support posts is a protected component according to claim 1.

31. A device for use in molten metal, the device including: (a) a drive source; (b) a drive shaft having a first end connected to the drive source and a second end; and (c) an impeller connected to the second end of the drive shaft. wherein one or more of the group consisting of the drive shaft and the impeller is a protected component according to claim 1.

32. The device of claim 31 wherein the device is a rotary degasser.

33. The device of claim 31 wherein the device is a scrap melter.

34. The device of claim 31 wherein the drive shaft is a protected component according to claim 1 and includes a non-coated component comprised of graphite and a protective coating comprised of one or more of the group consisting of nitride-bonded silicon carbide and aluminum oxide.

35. The device of claim 34 wherein the protective coating covers part of the non-coated component.

36. The device of claim 31 wherein the impeller is a protected component according to claim 1.

* * * * *